US008697975B2

(12) United States Patent
Iwase et al.

(10) Patent No.: US 8,697,975 B2
(45) Date of Patent: Apr. 15, 2014

(54) MUSICAL PERFORMANCE-RELATED INFORMATION OUTPUT DEVICE, SYSTEM INCLUDING MUSICAL PERFORMANCE-RELATED INFORMATION OUTPUT DEVICE, AND ELECTRONIC MUSICAL INSTRUMENT

(75) Inventors: Hiroyuki Iwase, Hamamatsu (JP); Takuro Sone, Hamamatsu (JP); Mitsuru Fukui, Hamamatsu (JP)

(73) Assignee: Yamaha Corporation (JP)

( * ) Notice: Subject to any disclaimer, the term of this patent is extended or adjusted under 35 U.S.C. 154(b) by 190 days.

(21) Appl. No.: 12/935,463

(22) PCT Filed: Jul. 29, 2009

(86) PCT No.: PCT/JP2009/063510

§ 371 (c)(1),
(2), (4) Date: Sep. 29, 2010

(87) PCT Pub. No.: WO2010/013752

PCT Pub. Date: Feb. 4, 2010

(65) Prior Publication Data

US 2011/0023691 A1 Feb. 3, 2011

(30) Foreign Application Priority Data

| | | |
|---|---|---|
| Jul. 29, 2008 | (JP) | 2008-194459 |
| Jul. 30, 2008 | (JP) | 2008-195687 |
| Jul. 30, 2008 | (JP) | 2008-195688 |
| Aug. 20, 2008 | (JP) | 2008-211284 |
| Jul. 22, 2009 | (JP) | 2009-171319 |
| Jul. 22, 2009 | (JP) | 2009-171320 |
| Jul. 22, 2009 | (JP) | 2009-171321 |
| Jul. 22, 2009 | (JP) | 2009-171322 |

(51) Int. Cl.
*G10H 7/00* (2006.01)

(52) U.S. Cl.
USPC ..... 84/600; 84/615; 84/601; 84/645

(58) Field of Classification Search
USPC ..... 84/600–602, 645, 615
See application file for complete search history.

(56) References Cited

U.S. PATENT DOCUMENTS 4,680,740 A * 7/1987 Treptow ..... 367/101

(Continued)

FOREIGN PATENT DOCUMENTS

JP 63-128810 A 6/1988

(Continued)

OTHER PUBLICATIONS

International Search Report issued in related PCT/JP2009/063510 mailed Sep. 8, 2009.

(Continued)

*Primary Examiner* — David S. Warren
(74) *Attorney, Agent, or Firm* — Rossi, Kimms & McDowell, LLP

(57) ABSTRACT

Provided are a musical performance-related information output device and a musical performance system capable of superimposing musical performance-related information on an audio signal without damaging the general versatility of the audio signal. The musical performance-related information output device includes a musical performance-related information acquiring section that is adapted to acquire musical performance-related information related to a musical performance of a performer, a superimposing section that is adapted to superimpose the musical performance-related information on an analog audio signal such that a modulated component of the musical performance-related information is included in a band higher than the frequency component of the analog audio signal generated in accordance with the musical performance manipulation of the performer, and an output section that outputs the analog audio signal on which the superimposing section superimposes the musical performance-related information.

39 Claims, 31 Drawing Sheets

(56) References Cited

U.S. PATENT DOCUMENTS

| | | | | |
|---|---|---|---|---|
| 4,964,000 | A * | 10/1990 | Kanota et al. | 360/77.14 |
| 5,025,702 | A * | 6/1991 | Oya | 84/659 |
| 5,212,551 | A * | 5/1993 | Conanan | 348/484 |
| 5,414,567 | A * | 5/1995 | Amada et al. | 386/310 |
| 5,423,073 | A | 6/1995 | Ogawa | |
| 5,612,943 | A | 3/1997 | Moses et al. | |
| 5,684,261 | A * | 11/1997 | Luo | 84/609 |
| 5,857,171 | A * | 1/1999 | Kageyama et al. | 704/268 |
| 5,886,275 | A * | 3/1999 | Kato et al. | 84/609 |
| 6,141,032 | A * | 10/2000 | Priest | 348/14.13 |
| 6,266,430 | B1 | 7/2001 | Rhoads | |
| 6,462,264 | B1 * | 10/2002 | Elam | 84/645 |
| 6,621,881 | B2 | 9/2003 | Srinivasan | |
| 7,009,942 | B2 | 3/2006 | Fujimori et al. | |
| 7,026,537 | B2 * | 4/2006 | Ishii | 84/617 |
| 7,161,079 | B2 | 1/2007 | Nishitani et al. | |
| 7,181,022 | B2 | 2/2007 | Rhoads | |
| 7,415,129 | B2 | 8/2008 | Rhoads | |
| 7,546,173 | B2 | 6/2009 | Waserblat et al. | |
| 7,572,968 | B2 * | 8/2009 | Komano | 84/609 |
| 7,620,468 | B2 | 11/2009 | Shimizu | |
| 8,023,692 | B2 | 9/2011 | Rhoads | |
| 8,103,542 | B1 | 1/2012 | Davis et al. | |
| 8,116,514 | B2 | 2/2012 | Radzishevsky | |
| 8,165,341 | B2 | 4/2012 | Rhoads | |
| 8,204,222 | B2 | 6/2012 | Rhoads | |
| 2001/0021188 | A1 | 9/2001 | Fujimori et al. | |
| 2001/0053190 | A1 | 12/2001 | Srinivasan | |
| 2002/0078146 | A1 | 6/2002 | Rhoads | |
| 2002/0166439 | A1 | 11/2002 | Nishitani et al. | |
| 2003/0161425 | A1 * | 8/2003 | Kikuchi | 375/354 |
| 2003/0190155 | A1 | 10/2003 | Tsutsui et al. | |
| 2003/0195851 | A1 | 10/2003 | Ong | |
| 2003/0196540 | A1 * | 10/2003 | Ishii | 84/617 |
| 2004/0137929 | A1 | 7/2004 | Jones et al. | |
| 2006/0078305 | A1 | 4/2006 | Arora et al. | |
| 2006/0133624 | A1 | 6/2006 | Waserblat et al. | |
| 2006/0219090 | A1 * | 10/2006 | Komano | 84/622 |
| 2006/0239503 | A1 | 10/2006 | Petrovic et al. | |
| 2006/0248173 | A1 | 11/2006 | Shimizu | |
| 2007/0169615 | A1 | 7/2007 | Chidlaw et al. | |
| 2007/0209498 | A1 * | 9/2007 | Lindgren et al. | 84/609 |
| 2007/0256545 | A1 * | 11/2007 | Lee et al. | 84/610 |
| 2008/0053293 | A1 | 3/2008 | Georges et al. | |
| 2008/0063226 | A1 | 3/2008 | Koyama et al. | |
| 2008/0101635 | A1 | 5/2008 | Dijkstra et al. | |
| 2008/0105110 | A1 | 5/2008 | Pietrusko et al. | |
| 2008/0119953 | A1 * | 5/2008 | Reed et al. | 700/94 |
| 2008/0243491 | A1 | 10/2008 | Matsuoka | |
| 2009/0070114 | A1 * | 3/2009 | Staszak | 704/260 |
| 2010/0023322 | A1 | 1/2010 | Schnell et al. | |
| 2010/0045681 | A1 | 2/2010 | Weissmueller, Jr. et al. | |
| 2010/0208905 | A1 | 8/2010 | Franck et al. | |
| 2010/0280907 | A1 | 11/2010 | Wolinsky et al. | |
| 2011/0023691 | A1 * | 2/2011 | Iwase et al. | 84/612 |
| 2011/0028160 | A1 | 2/2011 | Roeding et al. | |
| 2011/0029359 | A1 | 2/2011 | Roeding et al. | |
| 2011/0029362 | A1 | 2/2011 | Roeding et al. | |
| 2011/0029364 | A1 | 2/2011 | Roeding et al. | |
| 2011/0029370 | A1 | 2/2011 | Roeding et al. | |
| 2011/0066437 | A1 | 3/2011 | Luff | |
| 2011/0103591 | A1 | 5/2011 | Ojala | |
| 2011/0150240 | A1 | 6/2011 | Akiyama et al. | |
| 2011/0167390 | A1 * | 7/2011 | Reed et al. | 715/854 |
| 2011/0209171 | A1 | 8/2011 | Weissmueller, Jr. et al. | |
| 2011/0290098 | A1 * | 12/2011 | Thuillier | 84/645 |
| 2011/0319160 | A1 * | 12/2011 | Arn et al. | 463/30 |
| 2012/0065750 | A1 * | 3/2012 | Tissier et al. | 700/94 |
| 2013/0077447 | A1 | 3/2013 | Hiratsuka | |
| 2013/0179175 | A1 | 7/2013 | Biswas et al. | |
| 2013/0243203 | A1 | 9/2013 | Franck et al. | |
| 2013/0282368 | A1 | 10/2013 | Choo et al. | |
| 2013/0305908 | A1 | 11/2013 | Iwase et al. | |

FOREIGN PATENT DOCUMENTS

| | | | |
|---|---|---|---|
| JP | 5091063 | A | 4/1993 |
| JP | 08-286687 | A | 11/1996 |
| JP | 10-093449 | A | 4/1998 |
| JP | 2000-020054 | A | 1/2000 |
| JP | 2001-008177 | A | 1/2001 |
| JP | 2001203732 | A | 7/2001 |
| JP | 2002-175089 | A | 6/2002 |
| JP | 2002-341865 | A | 11/2002 |
| JP | 2003-280664 | A | 10/2003 |
| JP | 2003-295894 | A | 10/2003 |
| JP | 2003-316356 | A | 11/2003 |
| JP | 2004126214 | A | 4/2004 |
| JP | 2004-341066 | A | 12/2004 |
| JP | 2005-274851 | A | 10/2005 |
| JP | 2006100945 | A | 4/2006 |
| JP | 2006-163435 | A | 6/2006 |
| JP | 2006-251676 | A | 9/2006 |
| JP | 2006-287301 | A | 10/2006 |
| JP | 2006287730 | A | 10/2006 |
| JP | 2006-323161 | A | 11/2006 |
| JP | 2006-337483 | A | 12/2006 |
| JP | 2007-104598 | A | 4/2007 |
| JP | 4030036 | B2 | 1/2008 |
| JP | 2008072399 | A | 3/2008 |
| JP | 2008228133 | A | 9/2008 |
| WO | 2005-018097 | A2 | 2/2005 |
| WO | 2011014292 | A1 | 2/2011 |

OTHER PUBLICATIONS

ISR issued Nov. 2, 2009 for PCT/JP2009/063513.
Yamaha Digital Mixing Console Owner's Manual 2006.
Japanese office action issued in Japanese counterpart application No. JP2008-331081, dated Mar. 5, 2013. English translation provided.
Ryuki Tachibana, "Audio Watermarking for Live Performance", Proceedings of SPIE, International Society for Optical Engineering. vol. 5020, Jun. 1, 2003. pp.32-43, XP002442545.
European Search Report issued in European counterpart application No. EP09802996.0. Dated Mar. 27, 2013.
Office Action issued in Corresponding Japanese Patent Application No. 2009-171319 dated Sep. 17, 2013. English Translation provided.
Office Action issued in Corresponding Japanese Patent Application No. 2009-171320 dated Sep. 17, 2013. English Translation provided.
Office Action issued in Corresponding Japanese Patent Application No. 2009-171321 dated Sep. 10, 2013. English Translation provided.
Extended European Search Report for corresponding EP 09802994.5, dated Oct. 17, 2013.
Japanese Office Action for related JP 2008-253532, dated Sep. 26, 2013. English translation provided.
Japanese Office Action for related JP 2008-196492, dated Sep. 24, 2013. English translation provided.
Japanese Office Action for JP 2008-331081, dated Jun. 18, 2013.

* cited by examiner (CONT.)

(FIG. 2 CONTINUED)
(B)
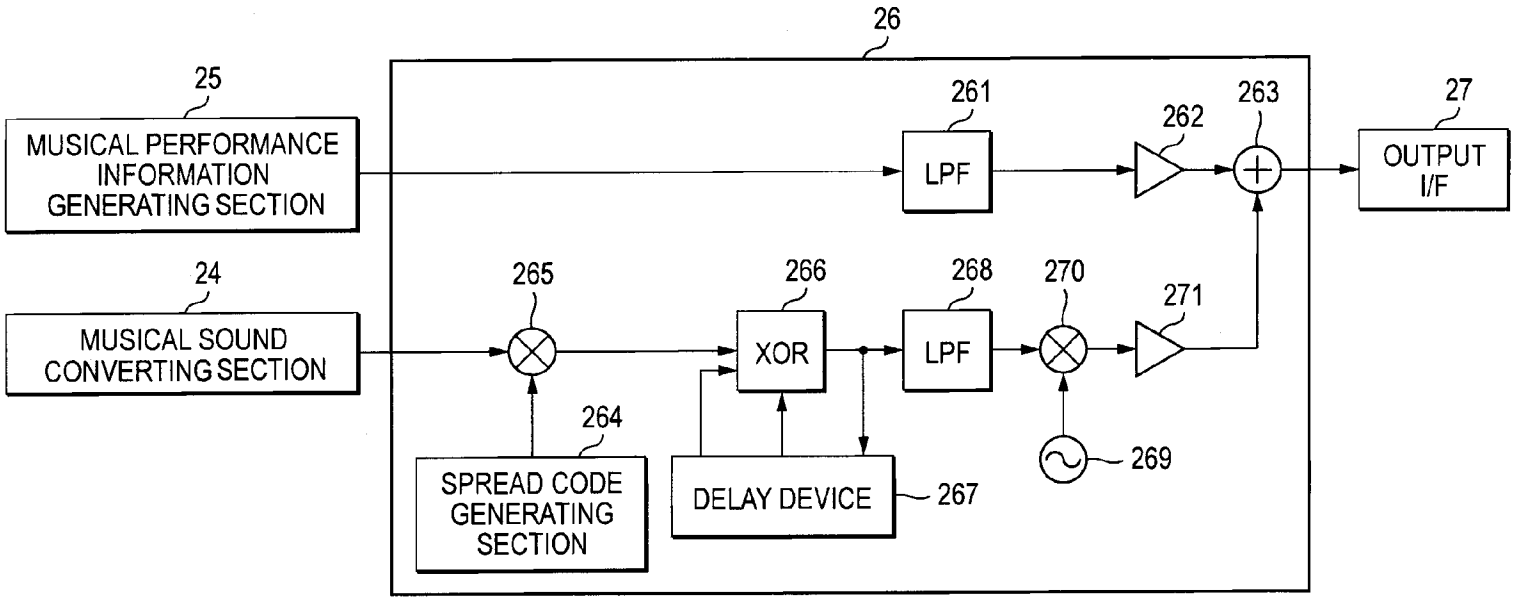

(A)

| | | |
|---|---|---|
| 1 MINUTE 15 SECONDS | 5 STRING 5 FRET<br>3 STRING 4 FRET | STROKE |
| 1 MINUTE 17 SECONDS | 3 STRING 4 FRET<br>2 STRING 2 FRET<br>1 STRING 3 FRET | STROKE x TWICE |
| ⋮ | ⋮ | ⋮ |

(B)

(A)

(CONT.)

(FIG. 8 CONTINUED)
(B)
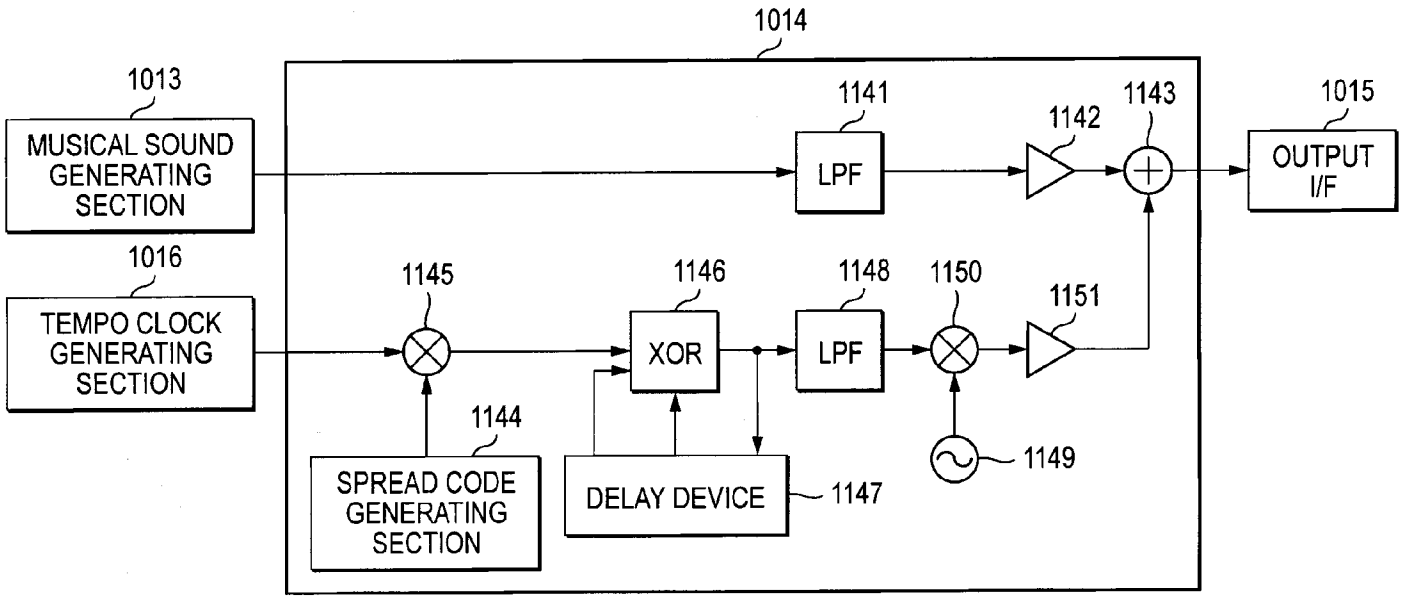

(A)

(CONT.)

(FIG. 10 CONTINUED)
(B)
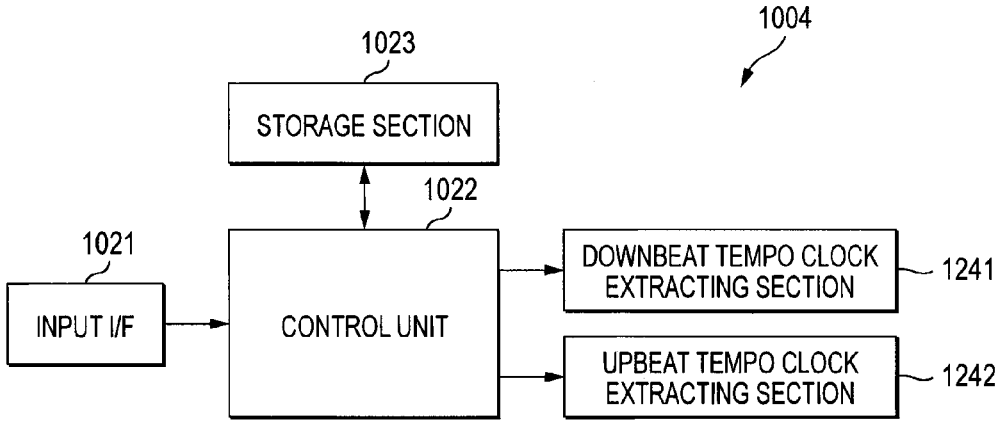
(C)
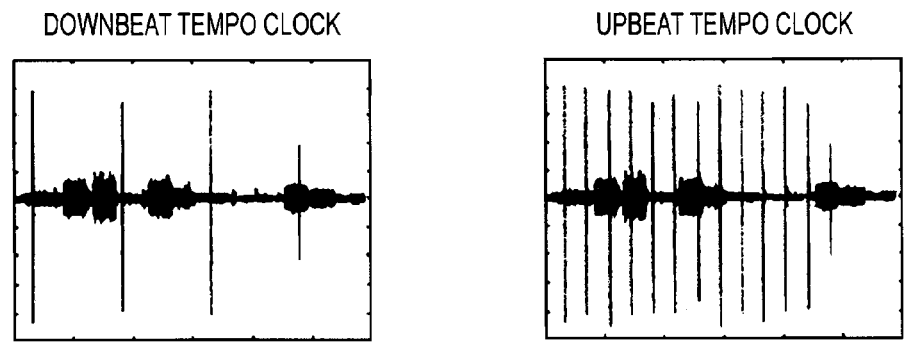

α: DIFFERENCE BETWEEN EACH BEAT OF TEMPO INFORMATION AND TIMING OF NOTE ON
T1: BASE TEMPO
T2: TEMPO AFTER TIME STRETCH
(CORRECTION TIME) = α x (T2/T1)

FIG. 16

| MUSICAL PERFORMANCE INFORMATION | CONTROL SIGNAL |
|---|---|
| DETECT PRESS OF SPECIFIC FRET (1ST STRING TO 6TH STRINGS OF 1 FRET) WITHOUT DETECTING VIBRATION OF STRING | START OF MUSICAL PERFORMANCE OF AUTOMATIC MUSICAL PERFORMANCE DEVICE |
| DETECT POSE (LOWER) IMMEDIATELY AFTER POSE (UPPER) IS DETECTED | STOP OF MUSICAL PERFORMANCE OF AUTOMATIC MUSICAL PERFORMANCE DEVICE |
| DETECT VIBRATION OF STRING IN STATE WHERE POSE (UPPER) IS DETECTED | TURN UP VOLUME OF MIXER |
| DETECT VIBRATION OF STRING IN STATE WHERE SPECIFIC FRET (2ND STRING 5TH FRET, 3RD STRING 6TH FRET) IS PRESSED | CHANGE EFFECT OF EFFECTS UNIT |
| ⋮ | ⋮ |

FIG. 18

| MUSICAL PERFORMANCE TIMING | MUSICAL PERFORMANCE INFORMATION | CONTROL SIGNAL |
|---|---|---|
| WITHIN 1 MINUTE FROM MUSICAL PERFORMANCE START | DETECT PRESS OF SPECIFIC FRET (1ST STRING TO 6TH STRING OF 1 FRET) WITHOUT DETECTING VIBRATION OF STRING | START OF MUSICAL PERFORMANCE OF AUTOMATIC MUSICAL PERFORMANCE DEVICE |
| DURING ONE BAR | DETECT POSE (LOWER) IMMEDIATELY AFTER POSE (UPPER) IS DETECTED | STOP OF MUSICAL PERFORMANCE OF AUTOMATIC MUSICAL PERFORMANCE DEVICE |
| DURING 1 MINUTE TO 2 MINUTES FROM MUSICAL PERFORMANCE START | DETECT VIBRATION OF STRING IN STATE WHERE POSE (UPPER) IS DETECTED | TURN UP VOLUME OF MIXER |
| DURING 8TH BEAT TO 10TH BEAT, 14TH BEAT TO 20TH BEAT FROM MUSICAL PERFORMANCE START | DETECT VIBRATION OF STRING IN STATE WHERE SPECIFIC FRET (2ND STRING 5TH FRET, 3RD STRING 6TH FRET) IS PRESSED | CHANGE EFFECT OF EFFECTS UNIT |
| ⋮ | ⋮ | ⋮ |

(A)

(CONT.)

(FIG. 21 CONTINUED)
(B)
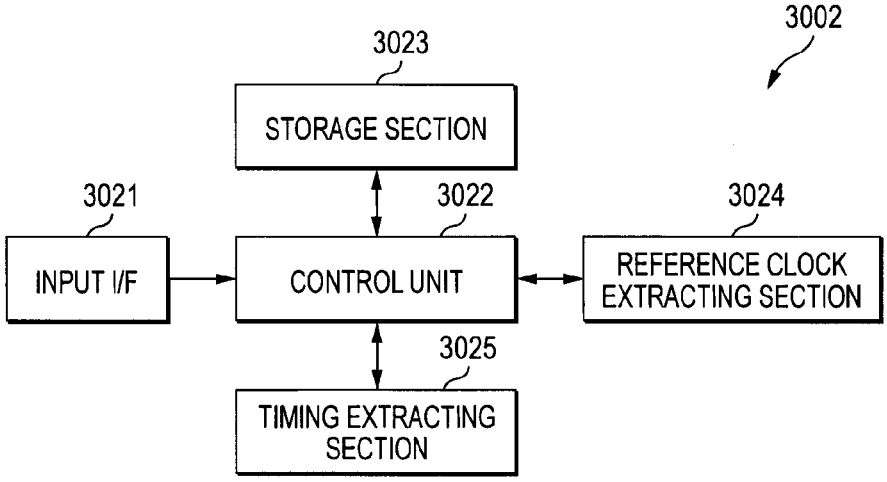
(C)
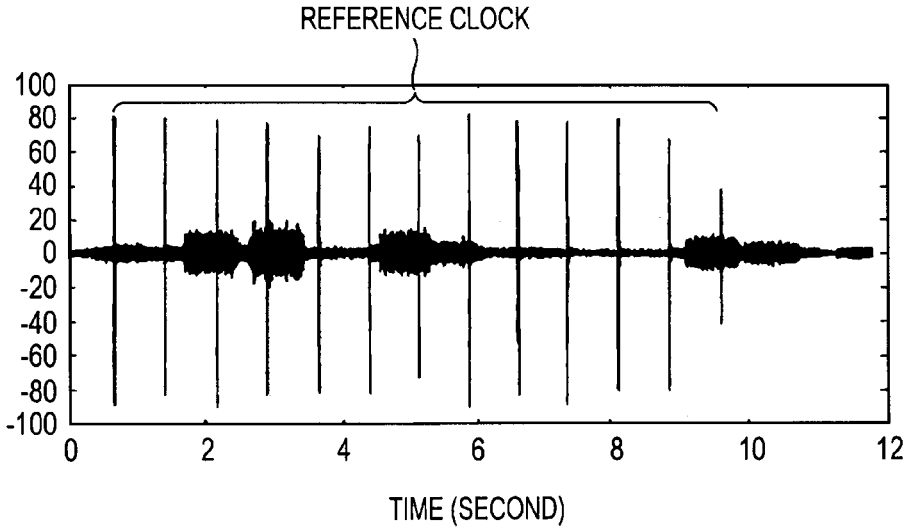

(A)

(B)

| | |
|---|---|
| (OFFSET VALUE) = 200 | MUSICAL PERFORMANCE INFORMATION |

(A)

(B)

| REFERENCE CLOCK OFFSET VALUE | IN-CLOCK OFFSET VALUE | MUSICAL PERFORMANCE INFORMATION |
|---|---|---|

(C)

| FLAG | REFERENCE CLOCK OFFSET VALUE | IN-CLOCK OFFSET VALUE | MUSICAL PERFORMANCE INFORMATION |
|---|---|---|---|

(D)

| 0 | (IN-CLOCK OFFSET VALUE) = 200 | MUSICAL PERFORMANCE INFORMATION |
|---|---|---|

(E)

| 1 | (REFERENCE CLOCK OFFSET VALUE) = 7 | (IN-CLOCK OFFSET VALUE) = 200 | MUSICAL PERFORMANCE INFORMATION |
|---|---|---|---|

(A)

(CONT.)

(FIG. 25 CONTINUED)
(B)
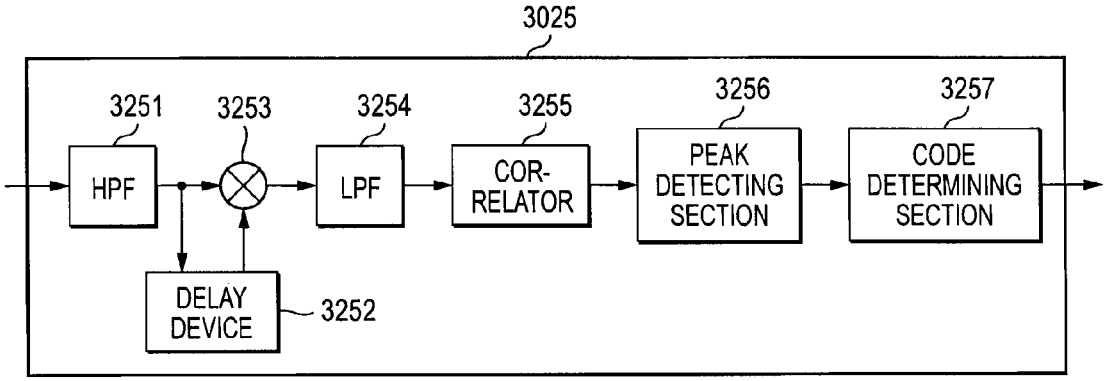

MUSICAL PERFORMANCE-RELATED INFORMATION OUTPUT DEVICE, SYSTEM INCLUDING MUSICAL PERFORMANCE-RELATED INFORMATION OUTPUT DEVICE, AND ELECTRONIC MUSICAL INSTRUMENT

This application is a U.S. National Phase Application of PCT International Application PCT/JP2009/063510 filed on Jul. 29, 2009 which is based on and claims priority from JP 2008-194459 filed on Jul. 29, 2008, JP 2008-195687 filed on Jul. 30, 2008, JP2008-195688 filed Jul. 30, 2008, JP 2008-211284 filed Aug. 20, 2008, JP 2009-171319 filed Jul. 22, 2009, JP 2009-171320 filed Jul. 22, 2009, JP 2009-171321 filed Jul. 22, 2009 and JP 2009-171322 filed Jul. 22, 2009, the contents of which is incorporated herein in its entirety by reference.

TECHNICAL FIELD

The present invention relates to a musical performance-related information output device which outputs an audio signal and musical performance-related information related to a musical performance of a performer, a system including the musical performance-related information output device, and an electronic musical instrument.

BACKGROUND ART

Various electronic musical instruments have been suggested which output audio data and musical performance information of musical instruments (for example, see Patent Literature 1).

Musical performance information of musical instruments is stored as easily modifiable MIDI data separately from audio data. For this reason, an electronic musical instrument includes an audio terminal and a MIDI terminal, such that audio data is output from the audio terminal and musical performance information of a musical instrument is output from the MIDI terminal. Thus, two terminals (audio terminal and MIDI terminal) have to be provided.

Since MIDI data includes tempo information, it is easy to regulate the reproduction time (tempo). In synchronizing audio data and MIDI data, audio data is recorded in synchronization with MIDI data. When existing audio data is used, it is necessary to manually regulate tempo information of MIDI data so as to match audio data. However, when the tempo is changed in the course of audio data, it takes a lot of labor to manually regulate the tempo information of MIDI data.

Various electronic musical instruments have also been suggested which control an external apparatus (for example, see Patent Literature 1).

For example, when a mixer is controlled by an electronic musical instrument, the electronic musical instrument stores a control signal for controlling the mixer as MIDI data, and outputs MIDI data to the mixer to control the mixer. For this reason, the electronic musical instrument has to include an audio output terminal for outputting an audio signal and a MIDI terminal for outputting MIDI data.

Hence, in the data superimposing method described in Patent Literature 1, digital audio data and musical performance information of a musical instrument are associated with each other and output, such that audio data and musical performance information of a musical instrument are output from a single terminal.

In recent years, a signal processing technique, such as time stretch, has been used so as to regulate the tempo of audio data (see Patent Literature 2).

A technique has been suggested which embeds various kinds of data into an audio signal. For example, Patent Literature 3 describes a technique which embeds data into an audio signal by using an electronic watermark for the purpose of copyright protection.

Patent Literature 4 describes a technique which embeds a control signal into an audio signal in a time-series manner by using an electronic watermark.

CITATION LIST

Patent Literature

Patent Literature 1: JP-A-2003-316356
Patent Literature 2: JP-A-2003-280664
Patent Literature 3: JP-A-2006-251676
Patent Literature 4: JP-A-2006-323161

SUMMARY OF INVENTION

Technical Problem

However, according to the data superimposing method described in Patent Literature 1, MIDI data is stored in the LSB (Least Significant Bit) of audio data. Accordingly, if audio data is converted to compressed audio, such as MP3, or audio data is emitted as an analog audio signal, associated information may be lost. Although an application program is provided which treats audio data and MIDI data, since there is no general-use data format, the application program is lacking in convenience.

Meanwhile, in the time stretch described in Patent Literature 2, beats are extracted from audio data, and the tempo of the entire musical piece is changed with the absolute beat timing. In this case, however, the musical performance tempo of the performer is not reflected. That is, as shown by (A) in FIG. 13, during an actual musical performance, a performer does not conduct a musical performance in accordance with the absolute beat timing, but conducts a musical performance with varying the tempo faster or slower. For this reason, if the beats are extracted from audio data, time stretch is carried out, and as shown by (B) in FIG. 13, the tempo of the entire musical piece is changed with the absolute beat timing, the nuance (enthusiasm) of the musical performance is lost.

The method described in Patent Literature 3 has no consideration of the timing at which information is embedded. For this reason, for example, when a silent part exists, there is a problem in that information cannot be superimposed, or information is superimposed with a significant shift from the timing at which information has to be actually embedded.

Meanwhile, in Patent Literature 4, a time difference from the head of the audio signal is embedded, and in order to use the control signal at the time of reproduction, it is necessary to read the control signal from the head of the audio signal constantly. According to the method described in Patent Literature 4, a table (code list) has to be prepared in advance which indicates the relationship between the timing of the control signal and the timing of the musical performance, but it is impossible to use the method when the performer conducts a musical performance manipulation or the like randomly (in real time). In the method described in Patent Literature 2, the control signal is embedded in frames, but it is impossible to use the method when high resolution (for example, equal to or lower than several msec.) is necessary, for example, in a musical instrument musical performance.

Accordingly, an object of the invention is to provide a musical performance-related information output device and a system including the musical performance-related information output device capable of superimposing musical performance-related information (for example, musical performance information indicating a musical performance manipulation of a performer, tempo information indicating a musical performance tempo, a control signal for controlling an external apparatus, or the like) on an analog audio signal and outputting the resultant analog audio signal without damaging the general versatility of audio data.

Solution to Problem

In order to achieve the object, a musical performance-related information output device according to an aspect of the invention comprises: a musical performance-related information acquiring section that is configured to acquire musical performance-related information related to a musical performance of a performer; a superimposing section that is configured to superimpose the musical performance-related information on an analog audio signal such that a modulated component of the musical performance-related information is included in a band higher than a frequency component of the analog audio signal generated in accordance with a musical performance manipulation of the performer; and an output section that outputs the analog audio signal on which the superimposing section superimposes the musical performance-related information.

The above-described musical performance-related information output device may be configured in that the musical performance-related information acquiring section acquires musical performance information indicating the musical performance manipulation of the performer as the musical performance-related information.

The above-described musical performance-related information output device may be configured in that the musical performance-related information acquiring section acquires tempo information indicating a musical performance tempo as the musical performance-related information.

The above-described musical performance-related information output device may be configured in that the musical performance-related information acquiring section acquires a control signal for controlling an external apparatus as the musical performance-related information.

The above-described musical performance-related information output device may be configured in that the musical performance-related information acquiring section acquires information regarding a reference clock, sequence data, a timing of superimposing the sequence data, and a time difference between the timing of superimposing the sequence data and the reference clock, as the musical performance-related information.

Advantageous Effects of Invention

According to the above-described musical performance-related information output device, musical performance-related information can be superimposed on an analog audio signal without damaging the general versatility of audio data.

BRIEF DESCRIPTION OF DRAWINGS

FIG. 18 shows another example of the control signal database according to the fourth embodiment.

DESCRIPTION OF EMBODIMENTS

Embodiments of the invention will be described with reference to the drawings. Information related to a musical performance of a performer, such as musical performance information indicating a musical performance manipulation of a performer, tempo information indicating a musical performance tempo, a reference clock, a control signal (control information) for controlling an external apparatus, and the like, which will be described in the following embodiments may be collectively called musical performance-related information.

First Embodiment

Figure 1:
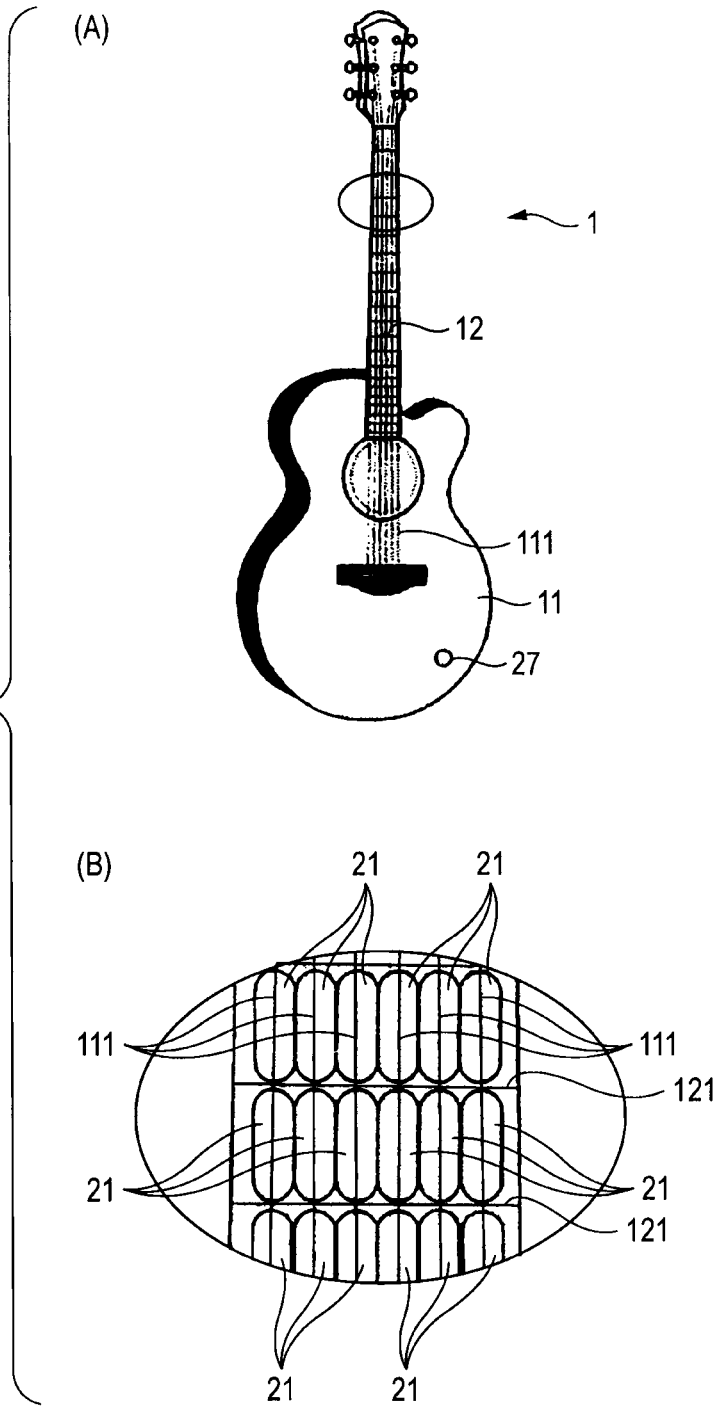
FIG. 1 is an appearance diagram showing the appearance of a guitar in a first embodiment of the invention.
Figure 2:
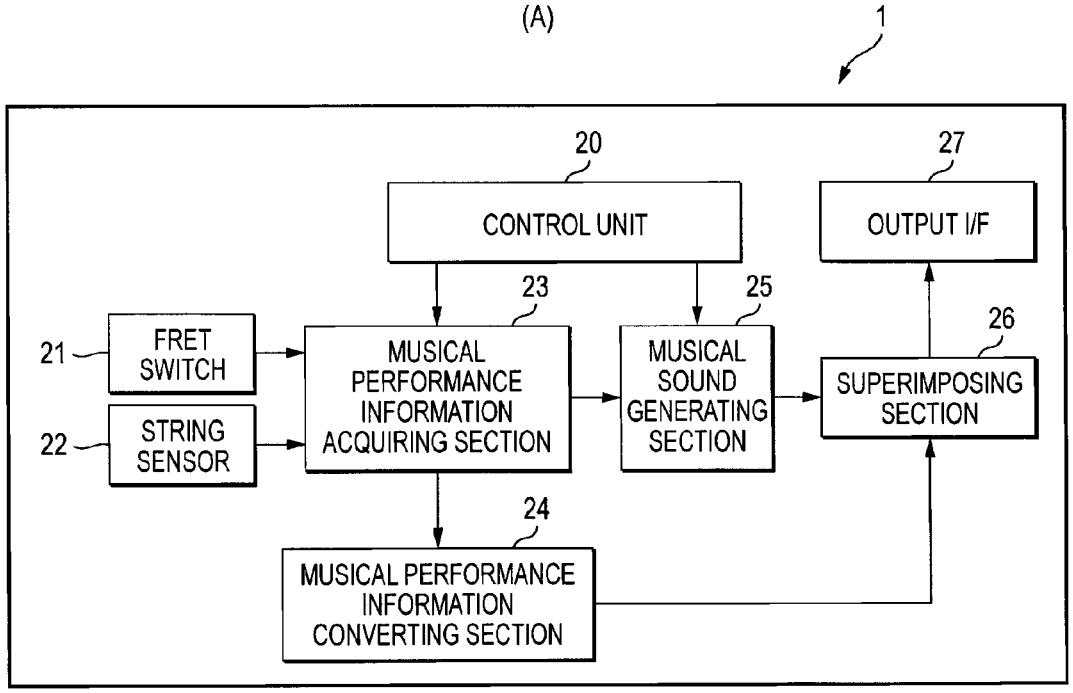
FIG. 2 is a block diagram showing the function and configuration of the guitar in the first embodiment.

A guitar 1 according to a first embodiment of the invention will be described with reference to FIGS. 1 and 2. FIG. 1 is an appearance diagram showing the appearance of the guitar. In FIG. 1, (A) is a top view of the appearance of the guitar when viewed from above. In FIG. 1, (B) is a partially enlarged view of a neck of the guitar. In FIG. 2, (A) is a block diagram showing the function and configuration of the guitar.

First, the appearance of the guitar 1 will be described with reference to FIG. 1. As shown by (A) in FIG. 1, the guitar 1 is an electronic stringed instrument (MIDI guitar), and includes a body 11 which is a body part and a neck 12 which is a neck part.

The body 11 is provided with six strings 111 which are played in guitar playing style, and an output I/F 27 which outputs an audio signal. With regard to the six strings 111, a string sensor 22 (see FIG. 2) is arranged to detect the vibration of the strings 111.

As shown by (B) in FIG. 1, the neck 12 is provided with frets 121 which divide the scales. Multiple fret switches 21 are arranged between the frets 121.

Next, the function and configuration of the guitar 1 will be described with reference to (A) in FIG. 2. As shown by (A) in FIG. 2, the guitar 1 includes a control unit 20, a fret switch 21, a string sensor 22, a musical performance information acquiring section (musical performance-related information acquiring section) 23, a musical performance information converting section 24, a musical sound generating section 25, a superimposing section 26, and an output I/F 27.

The control unit 20 controls the musical performance information acquiring section 23 and the musical sound generating section 25 on the basis of volume or tone set in the guitar 1.

The fret switch 21 detects switch-on/off, and outputs a detection signal indicating switch-on/off to the musical performance information acquiring section 23.

The string sensor 22 includes a piezoelectric sensor or the like. The string sensor 22 converts the vibration of the corresponding string 111 to a waveform to generate a waveform signal, and outputs the waveform signal to the musical performance information acquiring section 23.

The musical performance information acquiring section 23 acquires fingering information indicating the positions of the fingers of the performer on the basis of the detection signal (switch-on/off) input from the fret switch 21. Specifically, the musical performance information acquiring section 23 acquires a note number associated with the fret switch 21, which inputs the detection signal, and note-on (switch-on) and note-off (switch-off) of the note number.

The musical performance information acquiring section 23 acquires stroke information indicating the intensity of a stroke on the basis of the waveform signal input from the string sensor 22. Specifically, the musical performance information acquiring section 23 acquires the velocity (intensity of sound) at the time of note-on.

The musical performance information acquiring section 23 generates musical performance information (MIDI message) indicating the musical performance manipulation of the performer on the basis of the acquired fingering information and the stroke information, and outputs the musical performance information to the musical performance information converting section 24 and the musical sound generating section 25. At this time, even when note-on is input, if the stroke information is not input, the musical performance information acquiring section 23 determines that musical performance is not conducted, and deletes the corresponding fingering information. Specifically, when the velocity at the time of note-on of the note number is 0, the musical performance information acquiring section 23 deletes the note-on and note-off of the note number.

The musical performance information converting section 24 generates MIDI data on the basis of the musical performance information input from the musical performance information acquiring section 23, and outputs MIDI data to the superimposing section 26.

The musical sound generating section 25 includes a sound source. The musical sound generating section 25 generates an audio signal on the basis of the musical performance information input from the musical performance information acquiring section 23, and outputs the audio signal to the superimposing section 26.

The superimposing section 26 superimposes the musical performance information input from the musical performance information converting section 24 on the audio signal input from the musical sound generating section 25, and outputs the resultant audio signal to the output I/F 27. For example, the superimposing section 26 phase-modulates a high-frequency carrier signal with the musical performance information (as a data code string of 0 and 1), such that the frequency component of the musical performance information is included in a band different from the frequency component (acoustic signal component) of the audio signal. Further, the following spread spectrum may be used.

In FIG. 2, is a block diagram showing an example of the configuration of the superimposing section 26 when a spread spectrum is used. Although by (B) in FIG. 2, only digital signal processing has been described, the signals which are output to the outside may be analog signals (analog-converted signals).

In this example, a multiplier 265 multiples an M-series pseudo noise code (PN code) output from the spread code generating section 264 and the musical performance information (data code string of 0 and 1) to spread the spectrum of the musical performance information. The spread musical performance information is input to an XOR circuit 266. The XOR circuit 266 outputs an exclusive OR of the code input from the multiplier 265 and the output code before one sample input through a delay device 267 to differentially encode the spread musical performance information. It is assumed that the differentially-encoded signal is binarized with −1 and 1. The differential code binarized with −1 and 1 is output, such that the spread musical performance information can be extracted on the decoding side by multiplying the differential codes of two consecutive samples.

The differentially encoded musical performance information is band-limited to a baseband by an LPF (Nyquist filter) 268 and input to a multiplier 270. The multiplier 270 multiplies a carrier signal (a carrier signal in a band higher than the acoustic signal component) output from a carrier signal generator 269 and an output signal of the LPF 268, and frequency-shifts the differentially-encoded musical performance information to the pass-band. The differentially-encoded musical performance information may be up-sampled and then frequency-shifted. The frequency-shifted musical performance information is regulated in gain by a gain regulator 271, mixed with the audio signal by the adder 263, and output to the output I/F 27.

The audio signal output from the musical sound generating section 25 is subjected to pass-band cutting in an LPF 261, is regulated in gain by a gain regulator 262, and is then input to the adder 263. However, the LPF 261 is not essential, and the acoustic signal component and the component of the modulated signal (the frequency component of the musical performance information to be superimposed) do not have to be completely band-divided. For example, if the carrier signal is about 20 to 25 kHz, even when the acoustic signal component and the component of the modulated signal slightly overlap each other, it is difficult for a listener to listen to the modulated signal, and the SN ratio can be secured such that the musical performance information can be decoded. The frequency band on which the musical performance information is superimposed is desirably an inaudible range equal to or higher than 20 kHz, but in the configuration in which the inaudible range is not used due to D/A conversion, encoding of compressed audio, or the like, for example, the musical performance information is superimposed on a high-frequency band equal to or higher than 15 kHz, reducing the effect for the sense of hearing.

The audio signal on which the musical performance information is superimposed in the above-described manner is output from the output I/F 27 which is an audio output terminal. The audio signal is output to, for example, a storage device (not shown) and recorded as audio data.

Figure 3:
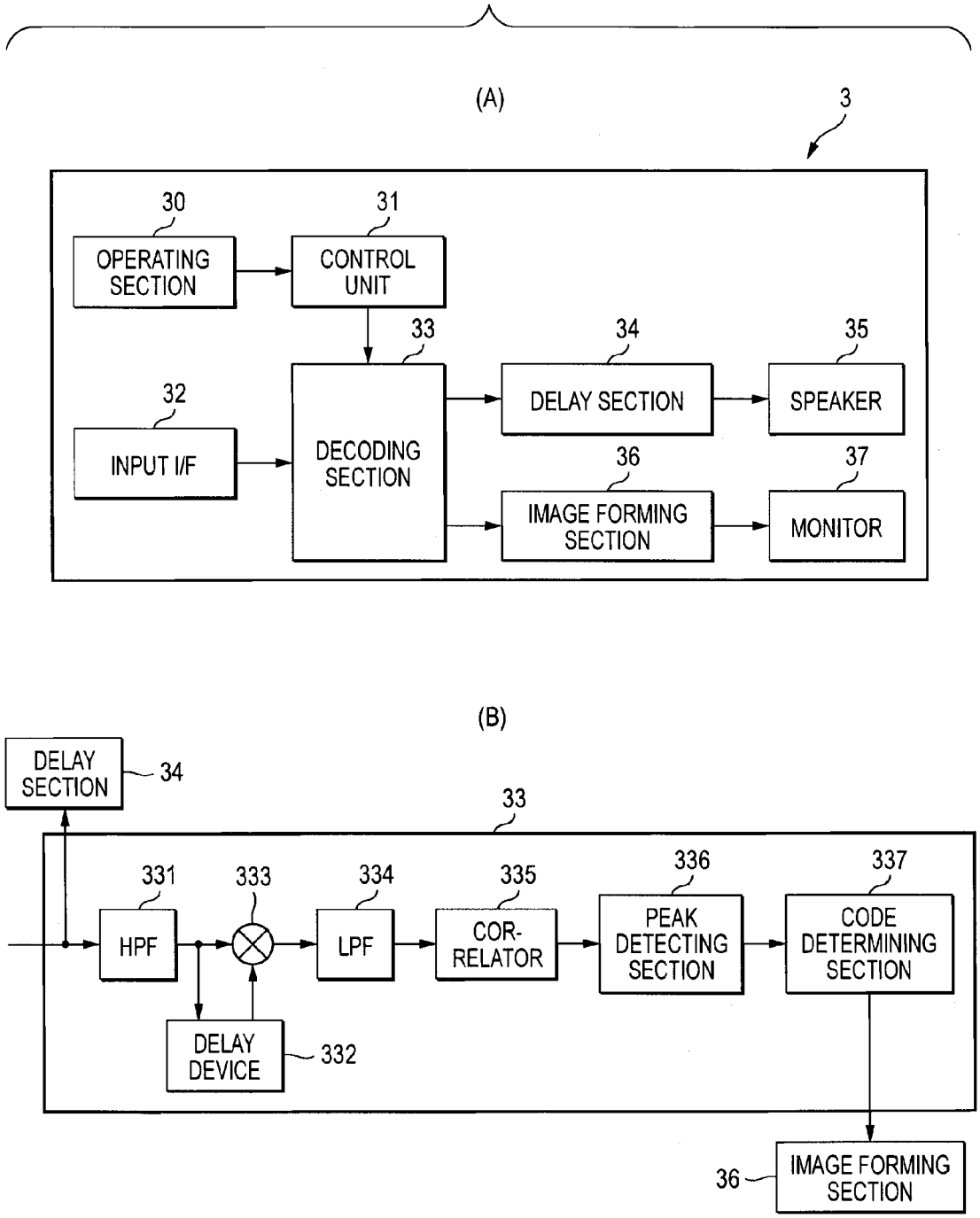
FIG. 3 is a block diagram showing the function and configuration of a reproducing device in the first embodiment.
Figure 4:
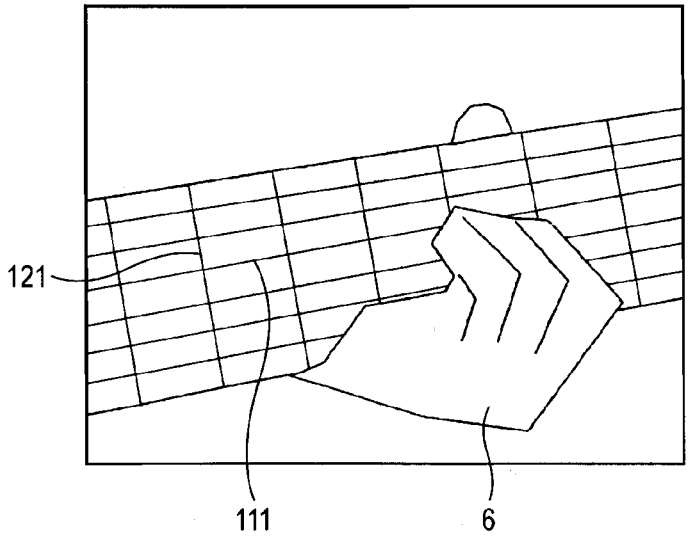
FIG. 4 is an example of a screen displayed on a monitor in the first embodiment.

Next, the usage of the recorded audio signal will be described. Although a musical piece based on the recorded audio signal can be reproduced by using a general reproducing device, here, a method will be described which reproduces the recorded audio signal by using a reproducing device 3 capable of decoding the musical performance information superimposed on the audio signal. The function and configuration of the reproducing device 3 will be described with reference to FIGS. 3 and 4. In FIG. 3, (A) is a block diagram showing the function and configuration of the reproducing device. FIG. 4 shows an example of a screen which is displayed on a monitor. In FIG. 4, (A) shows code information, and in FIG. 4, (B) shows the fingering information of the performer.

As shown by (A) in FIG. 3, the reproducing device 3 includes a manipulating section 30, a control unit 31, an input I/F 32, a decoding section 33, a delay section 34, a speaker 35, an image forming section 36, and a monitor 37.

The manipulating section 30 receives a manipulation input of a user and outputs a manipulation signal according to the manipulation input to the control unit 31. For example, the manipulating section 30 is a start button which instructs reproduction of the audio signal, a stop button which instructs stoppage of the audio signal, or the like.

The control unit 31 controls the decoding section 33 on the basis of the manipulation signal input from the manipulating section 30.

The audio signal on which the musical performance information is superimposed is input to the input I/F 32. The input I/F 32 outputs the input audio signal to the decoding section 33.

The decoding section 33 extracts and decodes the musical performance information superimposed on the audio signal input from the input I/F 32 on the basis of an instruction of the control unit 31 to acquire the musical performance information. The decoding section 33 outputs the audio signal to the delay section 34, and outputs the acquired musical performance information to the image forming section 36. The decoding method of the decoding section 33 is different from the superimposing method of the musical performance information in the superimposing section 26, but when the above-described spread spectrum is used, decoding is carried out as follows.

In FIG. 3, (B) is a block diagram showing an example of the configuration of the decoding section 33. The audio signal input from the input I/F is input to the delay section 34 and an HPF 331. The HPF 331 is a filter which removes the acoustic signal component. An output signal of the HPF 331 is input to a delay device 332 and a multiplier 333. A delay amount of the delay device 332 is set to the time for one sample of the differential code. When the differential code is up-sampled, the delay amount is set to the time for one sample after up-sampling. The multiplier 333 multiples the signal input from the HPF 331 and the signal before one sample output from the delay device 332, and carries out delay detection processing. The differentially encoded signal is binarized with −1 and 1, and indicates the phase change from the code before one sample. Thus, with multiplication by the signal before one sample, the musical performance information before differential encoding (spread code) is extracted.

An output signal of the multiplier 333 is extracted as a baseband signal through an LPF 334 which is a Nyquist filter, and is input to a correlator 335. The correlator 335 calculates the correlation with an input signal with the same spread code as the spread code output from the spread code generating section 264. A PN code having high self-correlativity is used for the spread code. Thus, with regard to a correlation value output from the correlator 335, the positive and negative peak components are extracted by a peak detecting section 336 in the period of the spread code (the period of the data code). A code determining section 337 decodes the respective peak components as the data code (0, 1) of the musical performance information. In this way, the musical performance information superimposed on the audio signal is decoded. The differential encoding processing on the superimposing side and the delay detection processing on the decoding side are not essential.

The delay section (synchronous output means) 34 delays and outputs the audio signal by the time (hereinafter, referred to as delay time) for generation or superimposition of the musical performance information in the guitar 1 or decoding in the reproducing device 3. Specifically, the delay section 34 includes a buffer (not shown in figure) which stores the audio signal for the delay time (for example, 1 millisecond to several seconds). The delay section 34 temporarily stores the audio signal input from the decoding section 33 in the buffer. If there is no free space in the buffer, the delay section 34 acquires the initially stored audio signal from the audio signals stored in the buffer and outputs the acquired audio signal to the speaker 35. Therefore, the delay section 34 can output the audio signal to the speaker 35 while delaying by the delay time.

The speaker 35 emits sound on the basis of the audio signal input from the delay section 34.

The image forming section 36 generates image data representing the musical performance manipulation on the basis of the musical performance information input from the decoding section 33, and outputs image data to the monitor 37. For example, as shown by (A) in FIG. 4, the image forming section 36 generates image data which displays code information in the sequence of the musical performance by the performer in association with the musical performance timing (the elapsed time after the musical performance starts). Further, for example, as shown by (B) in FIG. 4, the image forming section 36 generates image data which displays fingering information representing which fingers 6 depress the frets 121 and the strings 111.

The monitor 37 displays image data input from the image forming section 36.

As described above, the reproducing device 3 delays and outputs the audio signal later than the musical performance information by the delay time, it is possible to output the audio signal and the musical performance information at the same time (that is, synchronously). Therefore, the reproducing device 3 can display the code information or fingering information based on the musical performance information on the monitor 37 at the same time with emission of sound according to the musical performance information. As a result, the audience can listen to emitted sound while confirming the code information or fingering information through the monitor 37.

Although in the first embodiment, the fingering information and the stroke information are output as the musical performance information, the invention is not limited thereto. For example, only the fingering information may be output as musical performance information, or information regarding a button manipulation for changing tune or volume may be output as musical performance information.

Although in the first embodiment, even when note-on is input, if there is no stroke information (that is, when it is determined that the musical performance is not conducted), the musical performance information acquiring section 23 deletes the corresponding fingering information, the fingering information may not be deleted. Thus, the guitar 1 can acquire, as musical performance information, the movements of the fingers when the performer does not play the guitar 1. For example, when there is time until the next musical performance manipulation, the guitar 1 can acquire, as musical performance information, the positions of the fingers of the performer while the performer is waiting.

Although in the first embodiment, the audio signal on which the musical performance information is superimposed is output through the output I/F 27 and recorded, sound based on the audio signal on which the musical performance information is superimposed may be emitted and recorded by a microphone.

Although in the first embodiment, the guitar 1 has been described as an example, the invention is not limited thereto, and may be applied to an electronic musical instrument, such as an electronic piano or an electronic violin (MIDI violin). For example, in the case of an electronic piano, note-on and note-off information of the keyboard of the electronic piano, effect, or manipulation information of a filter or the like may be generated as musical performance information.

Although in the first embodiment, the code information or the fingering information is displayed on the monitor 37 on the basis of the musical performance information acquired by the decoding section 33, a score may be generated on the basis of the musical performance information. Therefore, a composer can generate a score by playing only the guitar 1, thus, in generating a score, complicated work for transcribing scales may not be carried out. Further, the electronic musical instrument may be driven on the basis of the musical performance information. If the tone of another guitar is selected in the electronic musical instrument, the performer of the guitar 1 can conduct a musical performance in unison with another guitar (electronic musical instrument).

In the first embodiment, the reproducing device 3 delays and outputs the audio signal later than the musical performance information by the delay time, it is possible to output the audio signal and the musical performance information at the same time. However, the reproducing device 3 may decode the musical performance information superimposed on the audio signal in advance, and may output the musical performance information in synchronization with the audio signal on the basis of the delay time, outputting the audio signal and the musical performance information at the same time.

Second Embodiment

Figure 5:
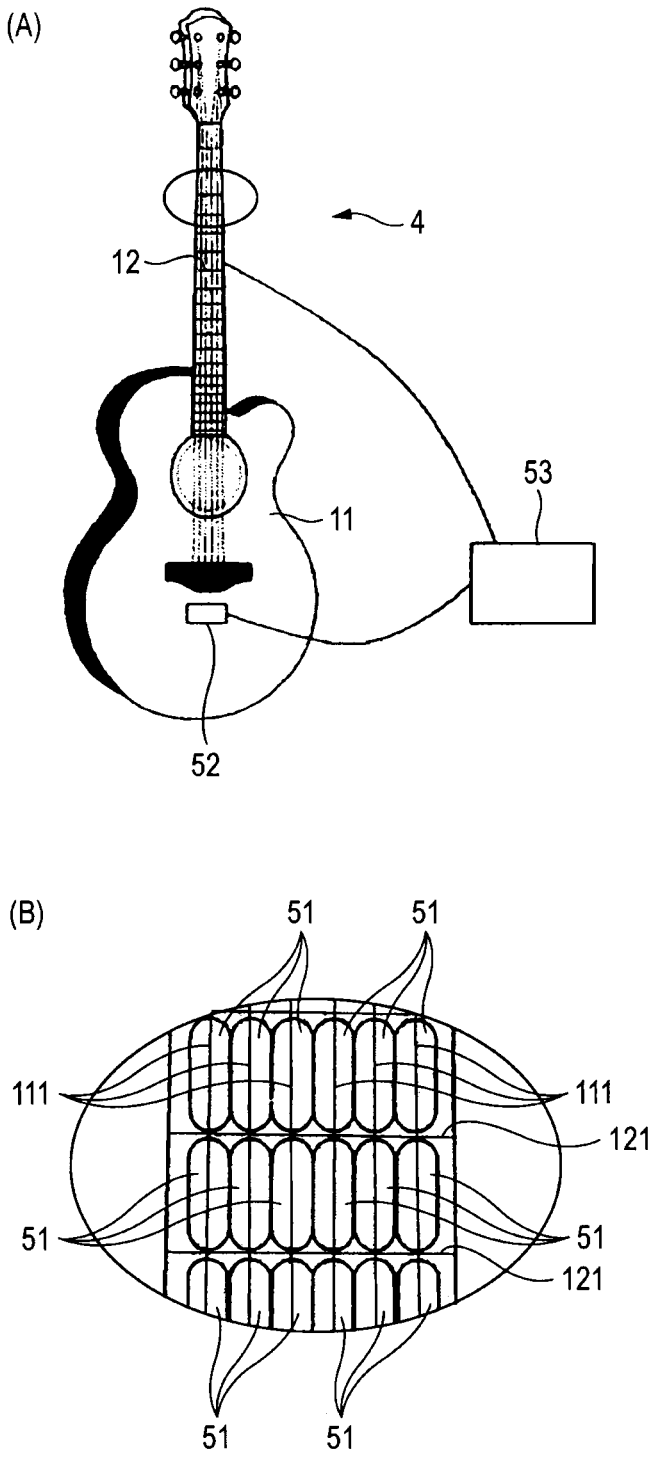
FIG. 5 is an appearance diagram showing the appearance of a guitar with a musical performance information output device in a second embodiment of the invention.
Figure 6:
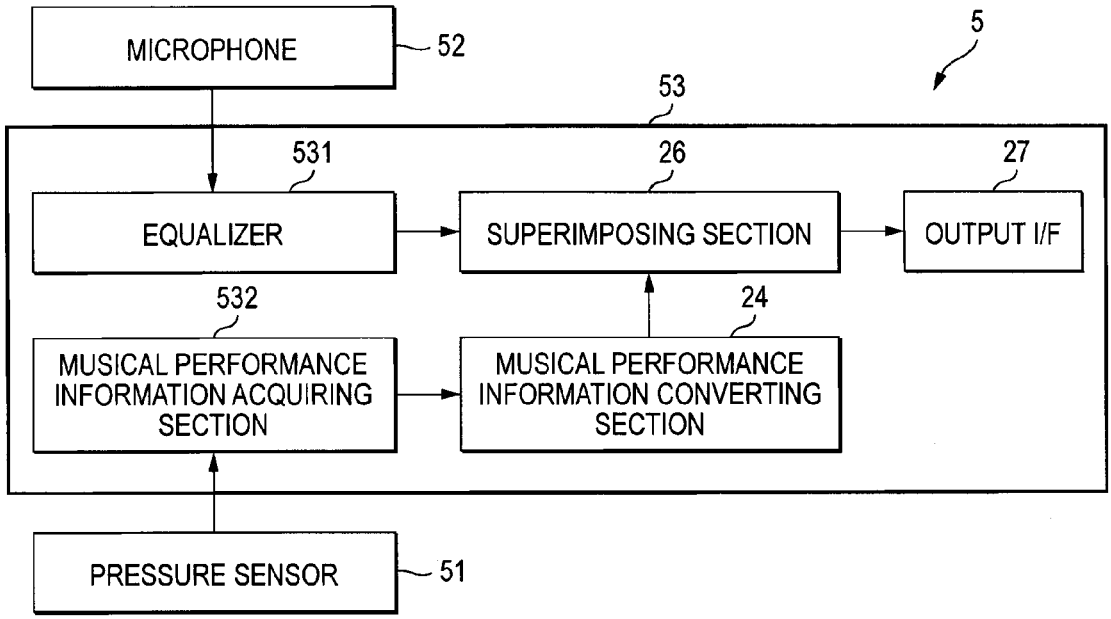
FIG. 6 is a block diagram showing the function and configuration of a musical performance information output device in the second embodiment.

A musical performance information output device 5 according to a second embodiment will be described with reference to FIGS. 5 and 6. FIG. 5 is an appearance diagram showing the appearance of a guitar with a musical performance information output device. In FIG. 5, (A) is a top view of the appearance of the guitar when viewed from above. In FIG. 5, (B) is a partial enlarged view of a neck of the guitar. FIG. 6 is a block diagram showing the function and configuration of the musical performance information output device. The second embodiment is different from the first embodiment in that an audio signal of a guitar 4 (acoustic guitar) which is an acoustic stringed instrument, instead of the audio signal of the guitar (MIDI guitar) 1 which is an electronic stringed instrument, is picked up by a microphone and recorded. The difference will be described.

As shown by (A) and (B) in FIG. 5, the musical performance information output device 5 includes multiple pressure sensors 51, a microphone 52 (corresponding to generating means), and a main body 53. The microphone 52 is provided in a body 11 of a guitar 4. The multiple pressure sensors 51 are provided between frets 121 formed in the neck 12 of the guitar 4.

The microphone 52 is, for example, a contact microphone for use in the pick-up or the like of a guitar or an electromagnetic microphone of an electric guitar. The contact microphone is a microphone which can be attached to the body of a musical instrument to cancel external noise and to detect not only the vibration of the strings 111 of the guitar 4 but also the resonance of the guitar 4. If power is turned on, the microphone 52 collects not only the vibration of the strings 111 of the guitar 4 but also the resonance of the guitar 4 to generate an audio signal. Then, the microphone 52 outputs the generated audio signal to an equalizer 531 (see FIG. 6).

A pressure sensor 51 outputs the detection result indicating the on/off of the corresponding fret 121 to a musical performance information acquiring section 532.

As shown in FIG. 6, the main body 53 is provided with an equalizer 531, a musical performance information acquiring section 532, a musical performance information converting section 24, a superimposing section 26, and an output I/F 27. The musical performance information converting section 24, the superimposing section 26, and the output I/F 27 have the same function and configuration as in the first embodiment, thus description thereof will be omitted.

The equalizer 531 regulates the frequency characteristic of the audio signal input from the microphone 52, and outputs the audio signal to the superimposing section 26.

The musical performance information acquiring section 532 generates fingering information indicating the on/off of the respective frets 121 on the basis of the detection result from the pressure sensor 51. The musical performance information acquiring section 532 outputs the fingering information to the musical performance information converting section 24 as musical performance information.

Thus, in the case of the guitar 4 which does not generate an audio signal, the musical performance information output device 5 can generate the audio signal in accordance with the vibration of the strings 111 of the guitar 4 or the resonance of the guitar 4, superimpose the musical performance information on the audio signal, and output the resultant audio signal.

Although in the second embodiment, an example has been described where the string sensors 22 which detect the vibration of the respective strings 111 are not provided, similarly to the first embodiment, the string sensors 22 which detect the vibration of the respective strings 111 may be provided. In this case, the musical performance information output device 5 can generate musical performance information including fingering information and stroke information.

Figure 7:
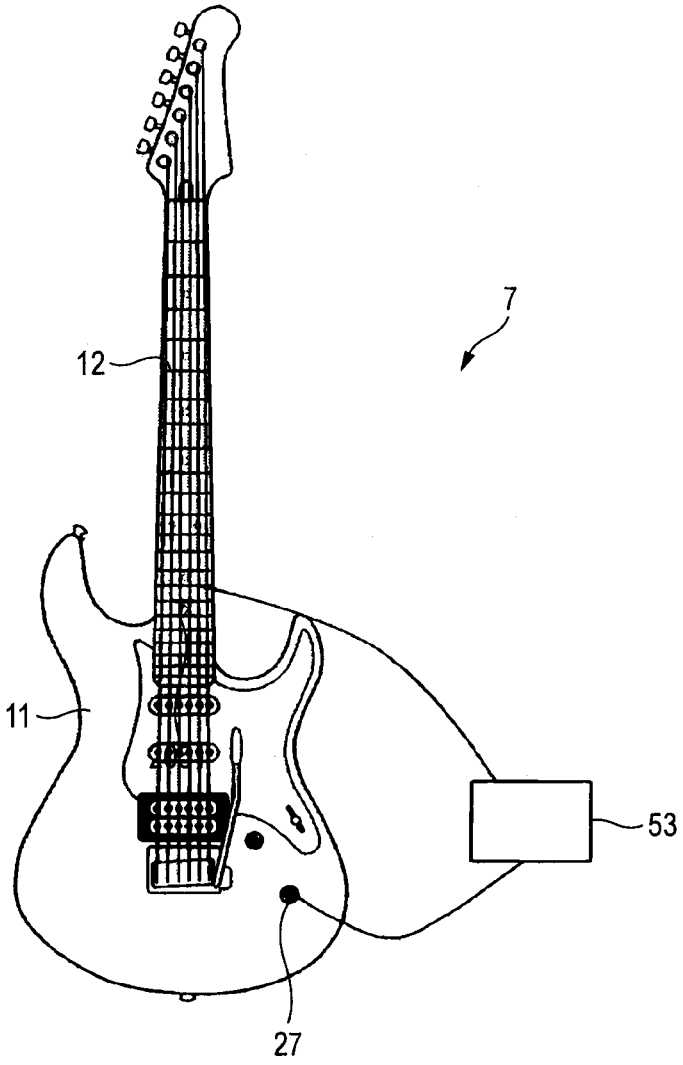
FIG. 7 is an appearance diagram showing the appearance of another guitar with a musical performance information output device in the second embodiment.

FIG. 7 is an appearance diagram showing the appearance of another guitar with a musical performance information output device. Although in the second embodiment, the acoustic guitar 4 has been described as an example, as shown in FIG. 7, even in an electric guitar, musical performance information can be output. An electric guitar 7 generates an audio signal itself, thus the audio signal is output from the output I/F 27 to the musical performance information output device 5 without using the microphone 52. A sensor which detects manipulation information of a tone arm for changing tune or a volume button for changing volume may be provided in the electric guitar 7, and the musical performance information output device 5 may output the manipulation information as musical performance information.

Although in the second embodiment, the guitar 4 has been described as an example, the invention is not limited thereto, and may be applied to an acoustic instrument, such as a grand piano (keyboard instrument) or a trumpet (wind instrument). For example, in the case of a grand piano, a microphone 52 is provided in the frame of the grand piano, and the musical performance information output device 5 generates an audio signal through sound collection of the microphone 52. A pressure sensor 51 which detects the on/off of each key and pressure applied to each key, or a switch which detects whether or not the pedal is stepped may be provided in the grand piano, and the musical performance information output device 5 may generate musical performance information on the basis of the detection result of the pressure sensor 51 or the switch.

For example, in the case of a trumpet, a microphone 52 is provided so as to cover the opening of the bell, and the musical performance information output device 5 collects emitted sound by the microphone 52 to generate an audio signal. A pressure sensor 51 for acquiring fingering information of the piston valves or a pneumatic sensor for acquiring how to blow the mouthpiece may be provided in the trumpet, and the musical performance information output device 5 may generate musical performance information on the basis of the detection result of the pressure sensor 51 or the pneumatic sensor.

The musical performance information output device acquires musical performance information indicating the musical performance manipulation of the performer (for example, in the case of a guitar, fingering information indicating which strings and which fret are depressed, stroke information indicating the intensity of a stroke, manipulation information of various buttons for volume regulation, tune regulation, and the like). The musical performance information output device superimposes the musical performance information on the analog audio signal such that a modulated component of the musical performance information is included in a band different from the frequency component of the audio signal generated in accordance with the musical performance information, and outputs the resultant analog audio signal.

For example, the musical performance information output device encodes M-series pseudo noise (PN code) through phase modulation with the musical performance information. The frequency band on which the musical performance information is superimposed is desirably an inaudible range equal to or higher than 20 kHz, but in the configuration in which an inaudible range is not used due to D/A conversion, encoding of compressed audio, or the like, for example, the musical performance information is superimposed on the high-frequency band equal to or higher than 15 kHz, reducing the effect for the sense of hearing. Then, the musical performance information output device emits sound based on the superimposed audio signal or outputs the superimposed audio signal from the audio terminal.

Thus, the musical performance information output device can output both the musical performance information and the audio signal from the single terminal (or through sound emission). When the signal is recorded, the musical performance information can be superimposed on general-use audio data.

The musical performance information output device includes generating means including a pickup, an acoustic microphone, or the like to generate an audio signal. Then, the musical performance information output device may superimpose the musical performance information on the generated audio signal and may output the resultant audio signal.

Thus, the musical performance information output device may not only be provided in the electronic musical instrument but also attached later to the existing musical instrument (for example, an acoustic guitar, a grand piano, an acoustic violin, or the like) for use.

A musical performance system includes the above-described musical performance information output device and a reproducing device. The reproducing device decodes the audio signal output from the musical performance information output device to acquire the musical performance information. The reproducing device outputs the acquired musical performance information and the audio signal. At this time, the reproducing device delays and outputs the audio signal later than the musical performance information by the time required for superimposition and decoding of the musical performance information, to output the audio signal and the musical performance information at the same time. The reproducing device decodes the musical performance information superimposed on the audio signal in advance and synchronously outputs the audio signal and the musical performance information, to output the audio signal and the musical performance information at the same time.

Thus, the code information or the fingering information based on the musical performance information is displayed on the monitor at the same time with emission of sound according to the musical performance information, thus the audience can listen to emitted sound while confirming the code information or the fingering information through the monitor.

Third Embodiment

Figure 8:
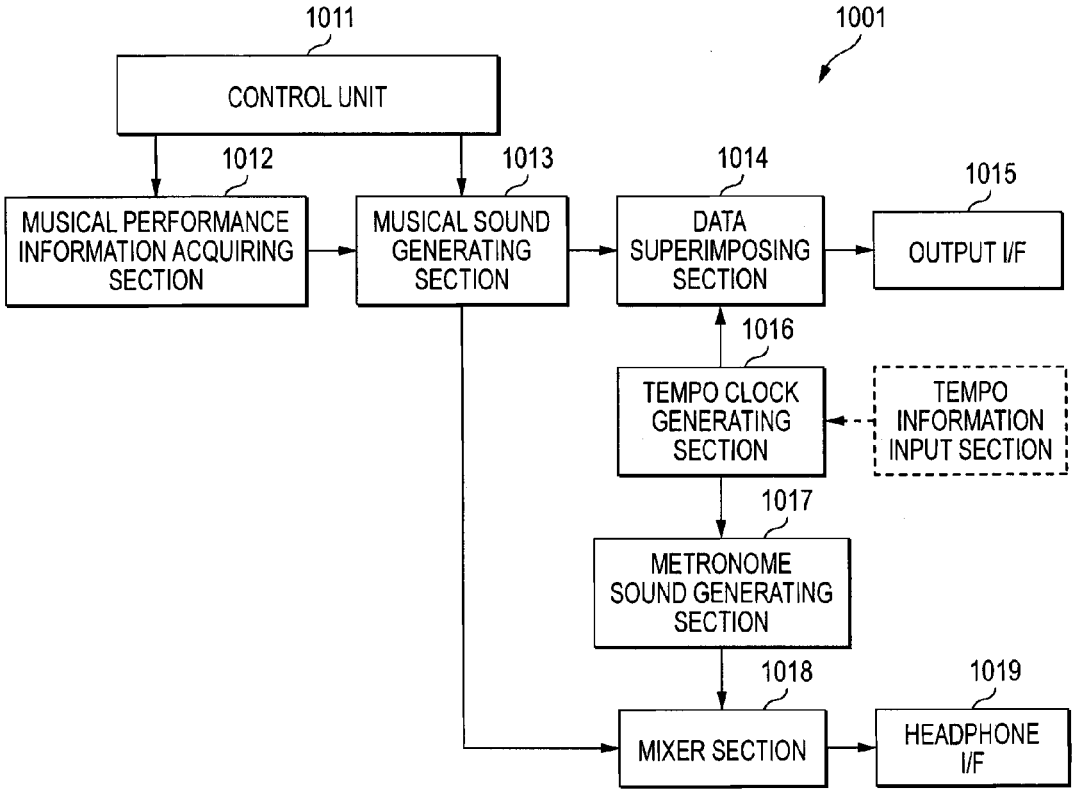
FIG. 8 is a block diagram showing the configuration of a tempo information output device according to a third embodiment of the invention.

In FIG. 8, (A) is a block diagram showing the configuration of a tempo information output device (musical performance-related information output device) according to a third embodiment of the invention. In FIG. 8, (A) shows an example where an electronic musical instrument (electronic piano) also serves as a tempo information output device. An electronic piano 1001 shown by (A) in FIG. 8 includes a control unit 1011, a musical performance information acquiring section (musical performance-related information acquiring section) 1012, a musical sound generating section 1013, a data superimposing section 1014, an output interface (I/F) 1015, a tempo clock generating section 1016, a metronome sound generating section 1017, a mixer section 1018, and a headphone I/F 1019.

The musical performance information acquiring section 1012 acquires musical performance information in accordance with a musical performance manipulation of a performer. The musical performance information is, for example, information of depressed keys (note number), the key depressing timing (note-on and note-off), the key depressing speed (velocity), or the like. The control unit 1011 instructs which musical performance information is output (on the basis of which musical performance information musical sound is generated).

The musical sound generating section 1013 includes an internal sound source, and receives the musical performance information from the musical performance information acquiring section 1012 in accordance with the instruction of the control unit 1011 (setting of volume or the like) to generate musical sound (audio signal).

The tempo clock generating section 1016 generates a tempo clock according to a set tempo. The tempo clock is, for example, a clock based on a MIDI clock (24 clocks per quarter notes), and is constantly output. The tempo clock generating section 1016 outputs the generated tempo clock to the data superimposing section 1014 and the metronome sound generating section 1017. The metronome sound generating section 1017 generates metronome sound in accordance with the input tempo clock. Metronome sound is mixed with musical sound by a musical performance of the performer in the mixer section 1018 and output to the headphone I/F 1019. The performer conducts the musical performance while listening to metronome sound (tempo) heard from the headphone.

A manipulator for tempo information input only (e.g., a tempo information input section indicated by a broken line in the drawing, such as a tap switch) may be provided in the electronic piano 1001 to input the beat defined by the performer as a reference tempo signal and to extract tempo information. When an automatic accompaniment is conducted in a musical instrument mounted in an automatic musical performance system (sequencer), the tempo clock generating section 1016 also outputs the tempo clock to the automatic musical performance system (for example, see FIG. 11).

The data superimposing section 1014 superimposes the tempo clock on the audio signal input from the musical sound generating section 1013. As the superimposing method, a method is used in which a superimposed signal is scarcely heard. For example, a high-frequency carrier signal is phase-modulated with the tempo information (as a data code string indicating a code 1 with the clock timing), such that the frequency component of the tempo information is included in a band different from the frequency component (acoustic signal component) of the audio signal.

A method may be used in which pseudo noise, such as a PN code (M series), is superimposed at a weak level with no discomfort for the sense of hearing. At this time, a band on which pseudo noise is superimposed may be limited to an out-of-audibility (equal to or higher than 20 kHz) band. Pseudo noise, such as M series, has extremely high self-correlativity. Thus, the correlation between the audio signal and the same code as superimposed pseudo noise is calculated on the decoding side, such that the tempo clock can be extracted. The invention is not limited to M series, and another random number, such as Gold series, may be used.

Each time the tempo clock is input from the tempo clock generating section 1016, the data superimposing section 1014 generates pseudo noise having a predetermined length, superimposes pseudo noise on the audio signal, and outputs the resultant audio signal to the output I/F 1015.

When pseudo noise is used, the following spread spectrum may be used. In FIG. 8, (B) is a block diagram showing an example of the configuration of the data superimposing section 1014 when a spread spectrum is used.

In this example, the M-series pseudo noise code (PN code) output from the spread code generating section 1144 and the tempo information (data code string of 0 and 1) are multiplied by a multiplier 1145, spreading the spectrum of the tempo information. The spread tempo information is input to an XOR circuit 1146. The XOR circuit 1146 outputs an exclusive OR of the code input from the multiplier 1145 and the output code before one sample input through a delay device 1147 to differentially encodes the spread tempo information. It is assumed that the differentially-encoded signal is binarized with −1 and 1. The differential code binarized with −1 and 1 is output, such that the spread tempo information can be extracted on the decoding side by multiplying the differential codes of two consecutive samples.

The differentially encoded tempo information is band-limited to the baseband in an LPF (Nyquist filter) 1148 and input to a multiplier 1150. The multiplier 1150 multiplies a carrier signal (a carrier signal in a band higher than the acoustic signal component) output from a carrier signal generator 1149 and an output signal of the LPF 1148, and frequency-shifts the differentially-encoded tempo information to the pass-band. The differentially-encoded tempo information may be up-sampled and then frequency-shifted. The frequency-shifted tempo information is regulated in gain by a gain regulator 1151, mixed with the audio signal by an adder 1143, and output to the output I/F 1015.

The audio signal output from the musical sound generating section 1013 is subjected to pass-band cutting in an LPF 1141, is regulated in gain by a gain regulator 1142, and is then input to the adder 1143. However, the LPF 1141 is not essential, and the acoustic signal component and the component of the modulated signal (the frequency component of the superimposed tempo information) do not have to be completely band-divided. For example, if the carrier signal is about 20 to 25 kHz, even when the acoustic signal component and the component of the modulated signal slightly overlap each other, it is difficult for the listener to listen to the modulated signal, and the SN ratio can be secured such that the tempo information can be decoded. The frequency band on which the tempo information is superimposed is desirably an inaudible range equal to or higher than 20 kHz, but in the configuration in which the inaudible range is not used due to D/A conversion, encoding of compressed audio, or the like, for example, the tempo information is superimposed on a high-frequency band equal to or higher than 15 kHz, reducing the effect for the sense of hearing.

The audio signal on which the tempo information is superimposed in the above-described manner is output from the output I/F 1015 which is an audio output terminal.

Figure 9:
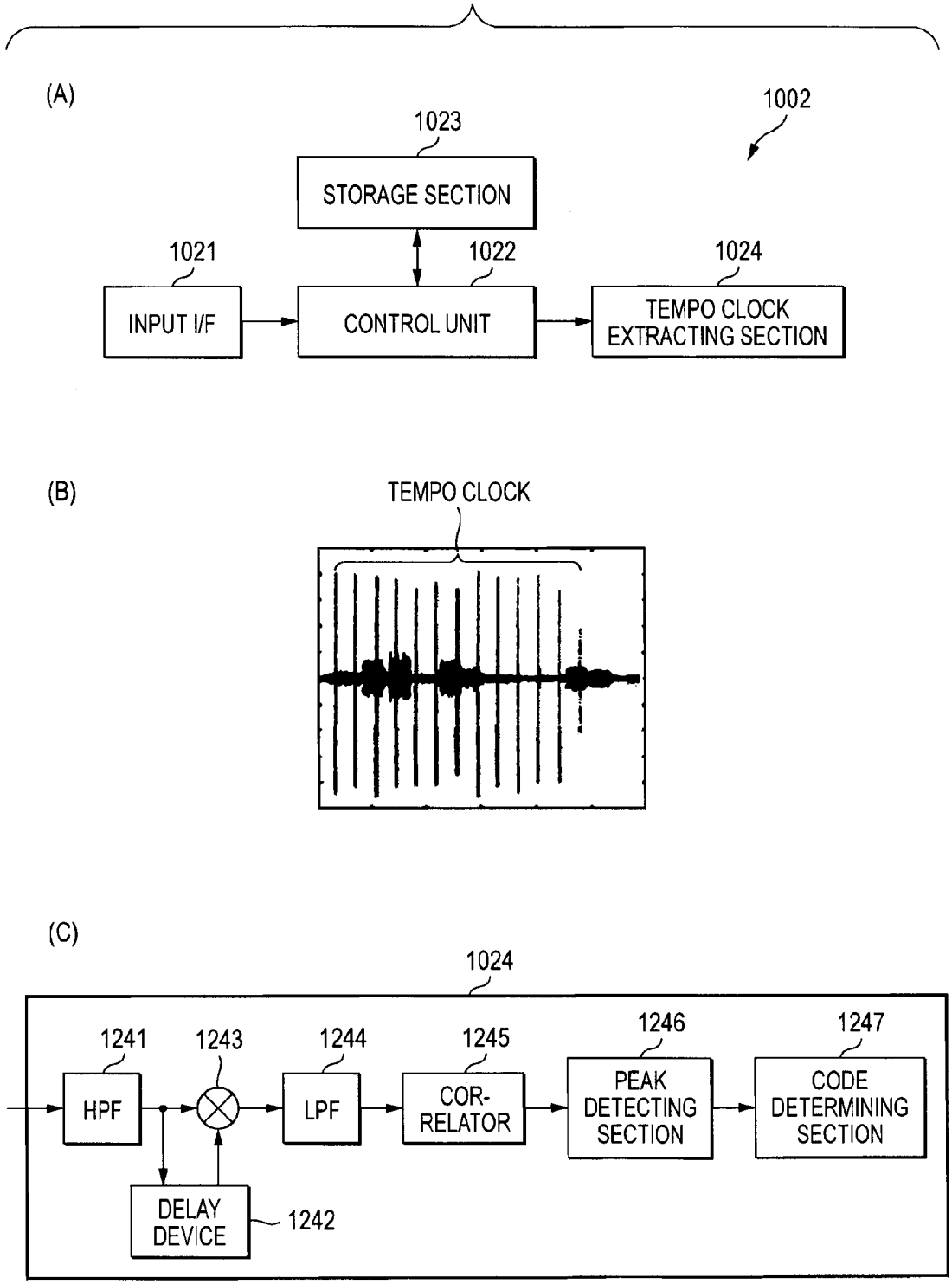
FIG. 9 is a block diagram showing the configuration of a decoding device according to the third embodiment.

The audio signal output from the output I/F 1015 is input to a decoding device 1002 shown by (A) in FIG. 9. The decoding device 1002 has a function as a recorder for recording an audio signal, a function as a reproducer for reproducing an audio signal, and a function as a decoder for decoding tempo information superimposed on an audio signal. The audio signal output from the electronic piano 1001 can be treated similarly to the usual audio signal, and can be thus recorded by another general recorder. Recorded audio data is general-use audio data, and can be thus reproduced by a general audio reproducer.

Here, with regard to the decoding device 1002, the function for decoding tempo information superimposed on an audio signal and the use example of the decoded tempo information will be mainly described.

In (A) of FIG. 9, the decoding device 1002 includes an input I/F 1021, a control unit 1022, a storage section 1023, and a tempo clock extracting section 1024. The control unit 1022 records an audio signal input from the input I/F 1021, and records the audio signal in the storage section 1023 as general-use audio data. The control unit 1022 reads audio data recorded in the storage section 1023 and outputs audio data to the tempo clock extracting section 1024.

The tempo clock extracting section 1024 generates pseudo noise identical to pseudo noise generated by the data superimposing section 1014 of the electronic piano 1001 and calculates the correlation with the reproduced audio signal. Pseudo noise superimposed on the audio signal is a signal having extremely high self-correlativity. Thus, when the correlation between the audio signal and the pseudo noise is calculated, as shown by (B) in FIG. 9, a steep peak is extracted regularly. The peak-generated timing of the correlation represents a musical performance tempo (tempo clock).

When the spread spectrum described with reference to (B) in FIG. 8 is used, the tempo clock extracting section 1024 decodes the tempo information and extracts the tempo clock as follows. In FIG. 9, (C) is a block diagram showing an example of the configuration of the tempo clock extracting section 1024. The input audio signal is input to an HPF 1241. The HPF 1241 is a filter which removes the acoustic signal component. An output signal of the HPF 1241 is input to a delay device 1242 and a multiplier 1243. The delay amount of the delay device 1242 is set to the time for one sample of the above-described differential code. When the differential code is up-sampled, the delay amount is set to the time for one sample after up-sampling. The multiplier 1243 multiplies a signal input from the HPF 1241 and a signal before one sample output from the delay device 1242, and carries out delay detection processing. The differentially encoded signal is binarized with −1 and 1, and indicates the phase change from the code before one sample. Thus, with multiplication by the signal before one sample, the tempo information before differential encoding (the spread code) is extracted.

An output signal of the multiplier 1243 is extracted as a baseband signal through an LPF 1244 which is a Nyquist filter, and is input to a correlator 1245. The correlator 1245 calculates the correlation with an input signal with the same pseudo noise code as the pseudo noise code output from the spread code generating section 1144. With regard to a correlation value output from the correlator 1245, the positive and negative peak components are extracted by a peak detecting section 1246 in the period of pseudo noise (the period of the data code). A code determining section 1247 decodes the respective peak components as the data code (0,1) of the tempo information. In this way, the tempo information superimposed on the audio signal is decoded. The differential encoding processing on the superimposing side and the delay detection processing on the decoding side are not essential.

The tempo clock extracted in the above-described manner can be used for an automatic musical performance by a sequencer insofar as the tempo clock is based on the MIDI clock. For example, an automatic musical performance in which the sequencer reflects its own musical performance tempo can be realized.

Figure 11:
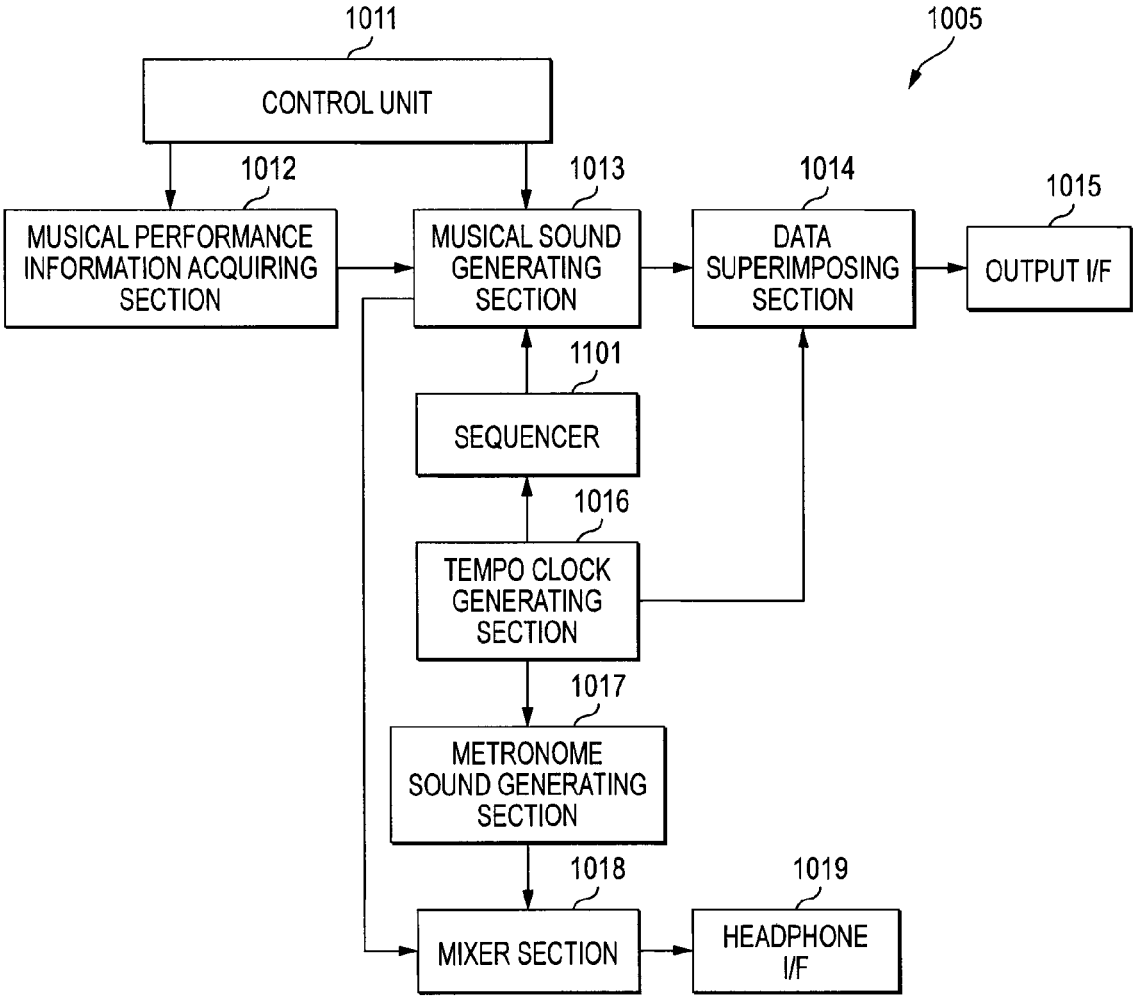
FIG. 11 is a block diagram showing the configuration of an electronic piano with an internal sequencer according to the third embodiment.

As shown in FIG. 11, in an electronic piano 1005 with an internal sequencer 1101, if the sequencer 1101 is configured to carry out an automatic musical performance on the basis of tempo information, musical sound by a musical performance of the performer and musical sound of the automatic musical performance can be synchronized with each other. Therefore, the performer can conduct only a musical performance manipulation to generate an audio signal in which musical sound by his/her musical performance and musical sound by an automatic musical performance are synchronized with each other. Further, like a karaoke machine, the audio signal can be synchronized with a video signal.

Figure 13:
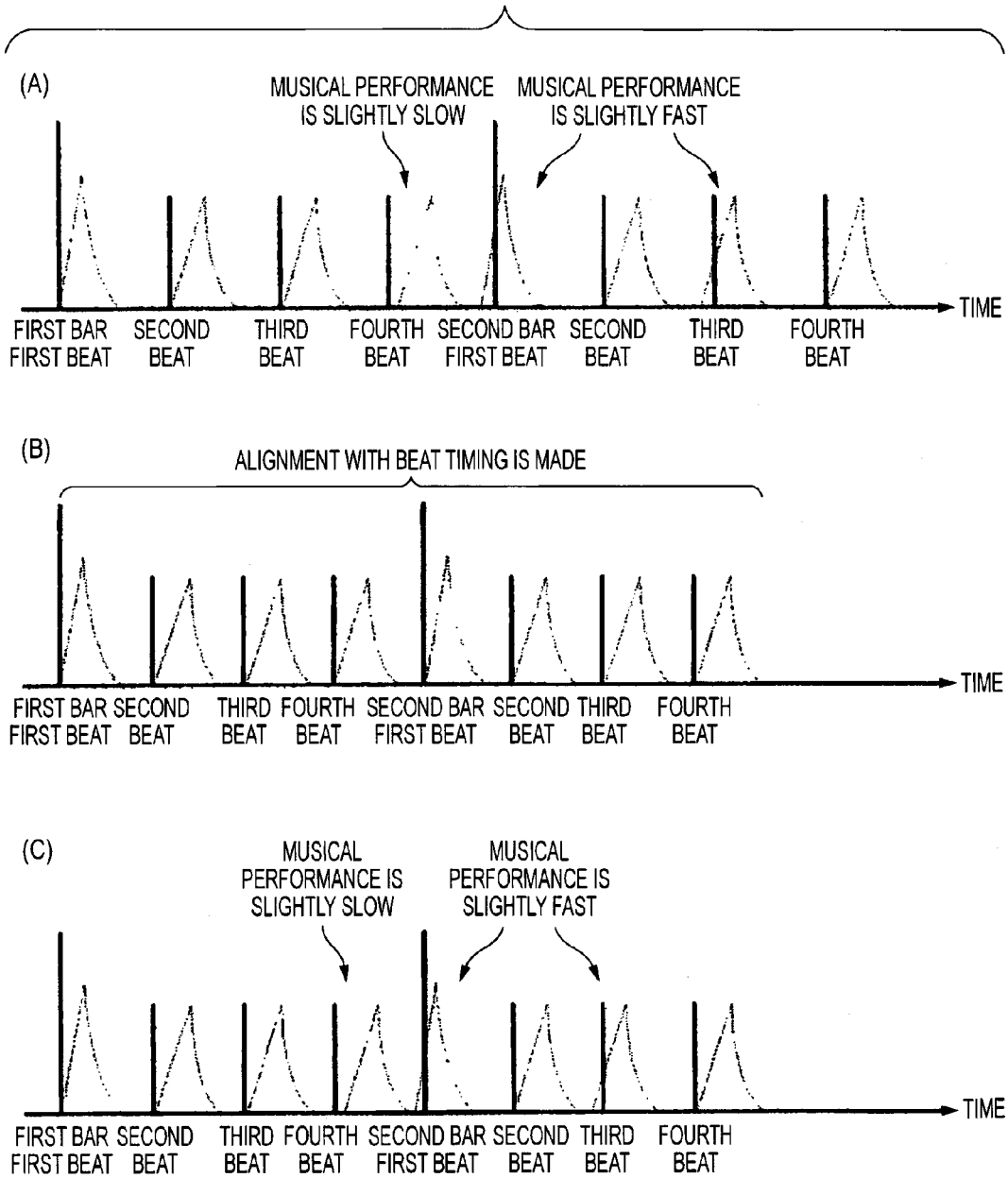
FIG. 13 is a diagram illustrating time stretch.

The extracted tempo clock may be used as a reference clock at the time of time stretch of audio data, significantly reducing complexity at the time of editing. As shown by (C) in FIG. 13, a correction time is calculated from the difference between the tempo information and the musical performance information included in base audio data subjected to time stretch, and the correction time is added to time-stretched audio data according to a new tempo, such that the tempo can be changed without losing the nuance (enthusiasm) of the musical performance. For example, where the difference between each beat of the tempo information and the timing of note-on is a, the base tempo is T1, and time-stretched the tempo is T2, the correction time becomes $\alpha\times(T2/T1)$. Therefore, even when time stretch is carried out, there is no case where the nuance of the musical performance is changed.

Figure 10:
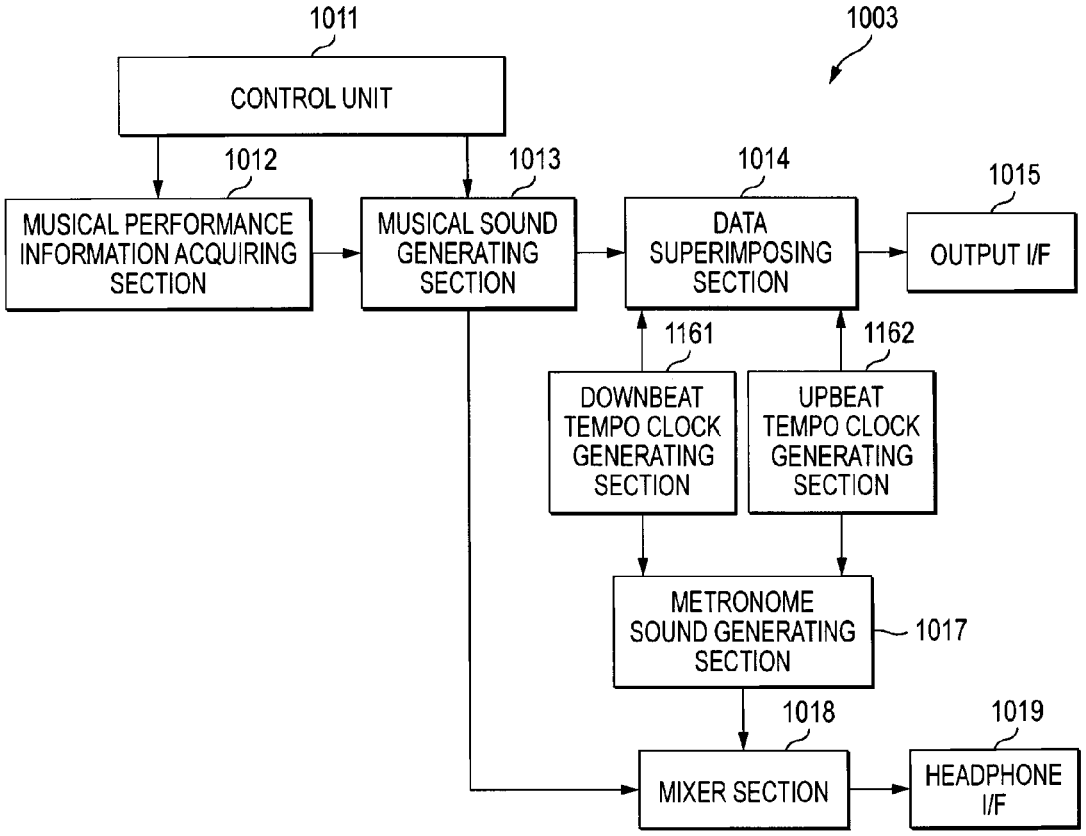
FIG. 10 is a block diagram showing the configuration of a tempo information output device and a decoding device according to an application of the third embodiment.

In the case of the superimposing method using pseudo noise, such as M series, various applications described below may be made. FIG. 10 is a block diagram showing the configuration of a tempo information output device and a decoding device according to an application example. The same parts as those in FIGS. 8 and 9 are represented by the same reference numerals, and description thereof will be omitted.

An electronic piano 1003 according to the application example includes a downbeat tempo clock generating section 1161 and an upbeat tempo clock generating section 1162, instead of the tempo clock generating section 1016. The decoding device 1004 includes a downbeat tempo clock extracting section 1241 and an upbeat tempo clock extracting section 1242, instead of the tempo clock extracting section 1024.

The downbeat tempo clock generating section 1161 generates a tempo clock for each downbeat timing (bar). The upbeat tempo clock generating section 1162 generates a tempo clock for each upbeat (beat) timing.

Each time the tempo clock is input from the downbeat tempo clock generating section 1161 and each time the tempo clock is input from the upbeat tempo clock generating section 1162, the data superimposing section 1014 generates pseudo noise and superimposes the pseudo noise on the audio signal. The data superimposing section 1014 generates the pseudo noise with different patterns (pseudo noise for downbeat and pseudo noise for upbeat) with the timing at which the tempo clock is input from the downbeat tempo clock generating section 1161 and with the timing at which the tempo clock is input from the upbeat tempo clock generating section 1162.

The downbeat tempo clock extracting section 1241 and the upbeat tempo clock extracting section 1242 of the decoding device 1004 respectively generate pseudo noise identical to pseudo noise for downbeat and pseudo noise for upbeat generated by the data superimposing section 1014, and calculates the correlation with the reproduced audio signal.

Pseudo noise for downbeat and pseudo noise for upbeat are superimposed on the audio signal for each bar timing and for each beat timing, respectively. These are signals having extremely high self-correlativity. Thus, if the correlation between the audio signal and pseudo noise is calculated, as shown by (C) in FIG. 10, a steep peak is extracted regularly. The peak-generated timing extracted by the downbeat tempo clock extracting section 241 represents the bar timing (downbeat tempo clock), and the peak-generated timing extracted by the upbeat tempo clock extracting section 1242 represents the beat timing (upbeat tempo clock). The signals of pseudo noise use different patterns, thus there is no case where the signals of pseudo noise interfere with each other, such that the correlation can be calculated with high accuracy.

In the case of four beats, the bar timing has a period four times greater than the beat timing, thus the noise length of the pseudo noise can be set four times greater. Therefore, the SN ratio can be secured by as much, and the level of pseudo noise can be reduced.

If more patterns of pseudo noise are used, different kinds of pseudo noise may be superimposed with each beat timing, and it is possible to cope with a variety of tempos, including a compound beat and the like. In particular, when Gold series is used as pseudo noise, various code series can be generated. Thus, even when a compound beat is used or even when the number of beats is large, different code series can be used for each beat. Even when the spread spectrum described with reference to (B) in FIG. 8 and (C) in FIG. 9 is used, the spread processing can be carried out for the tempo information using different kinds of pseudo noise with reach beat timing or bar timing.

Figure 12:
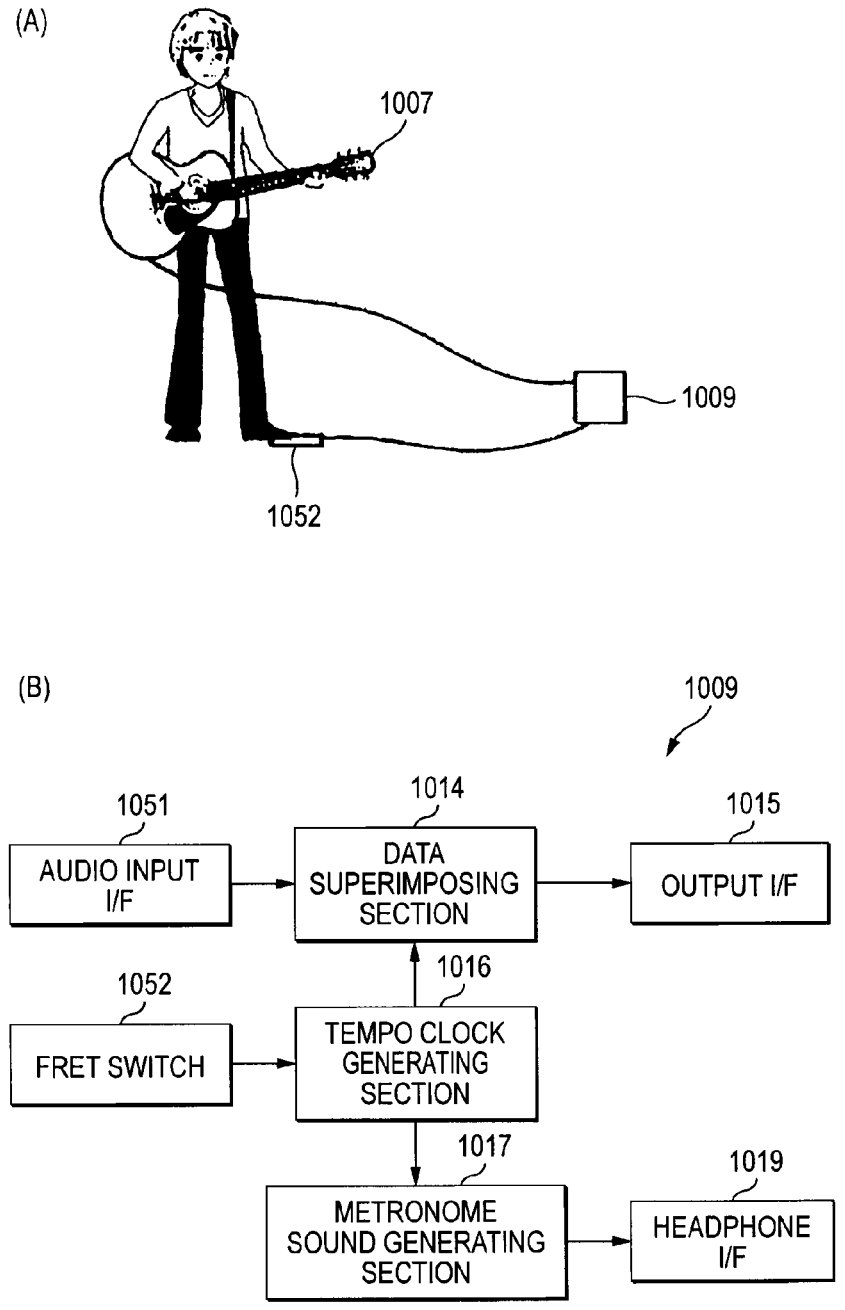
FIG. 12 shows an example where the tempo information output device according to the third embodiment is attached to an acoustic guitar.

The tempo information output device of this embodiment is not limited to a mode where a tempo information output device is embedded in an electronic musical instrument, and may be attached to the existing musical instrument later. FIG. 12 shows an example where a tempo information output device is attached to a guitar. In FIG. 12, an electric acoustic guitar will be described which outputs an analog audio signal. The same parts as those in FIG. 8 are represented by the same reference numerals, and description thereof will be omitted.

As shown by (A) in FIG. 12 and (B) in FIG. 12, a tempo information output device 1009 includes an audio input I/F 1051 and a fret switch 1052. A line output terminal of a guitar 1007 is connected to the audio input I/F 1051.

The audio input I/F 1051 receives musical performance sound (audio signal) from the guitar 1007, and outputs musical performance sound to the data superimposing section 1014. The fret switch 1052 is a manipulator for tempo information input only, and inputs the beat defined by the performer as a reference tempo signal. The tempo clock generating section 1016 receives the reference tempo signal from the fret switch 1052 and extracts tempo information.

As described above, the existing musical instrument having the audio output terminal can use the tempo information output device of the invention, and can superimpose the tempo information, in which the musical performance tempo of the performer is reflected, on the audio signal.

The tempo information output device of this embodiment is not limited to an example where a tempo information output device is attached to an electronic piano or an electric acoustic guitar. If musical sound is collected by the usual microphone, even an acoustic instrument having no line output terminal can use the tempo information output device of the invention. The invention is not limited to a musical instrument, and singing sound falls within the technical scope of an audio signal which is generated in accordance with the musical performance manipulation in the invention. Singing sound may be collected by a microphone, and tempo information may be superimposed on singing sound.

The tempo information output device (musical performance-related information output device) includes output means for outputting the audio signal generated in accordance with the musical performance manipulation of the performer. The tempo information indicating the musical performance tempo of the performer is superimposed on the audio signal. The tempo information output device superimposes the tempo information such that a modulated component of the tempo information is included in a band different from the frequency component of the audio signal. The tempo information is superimposed as beat information (tempo clock), such as a MIDI clock. The beat information is constantly output by the automatic musical performance system (sequencer).

For this reason, the tempo information output device can output the audio signal with the tempo information, in which the musical performance tempo of the performer is reflected (by the single line). The output audio signal can be treated in the same manner as the usual audio signal, thus the audio signal can be recorded by a recorder or the like and can be used as general-use audio data. The time difference from the actual musical performance timing can be calculated from the tempo information, and even when the reproduction time is regulated through time stretch or the like, there is no case where the nuance of the musical performance is changed. The tempo information output device includes a mode where a tempo information output device is embedded in an electronic musical instrument, such as an electronic piano, a mode where an audio signal is input from the existing musical instrument, a mode where acoustic instrument or singing sound is collected and an audio signal is input, and the like.

A reference tempo signal which is the reference of the musical performance tempo may be input from the outside, such as a metronome, and tempo information may be extracted on the basis of the reference tempo signal. The beat defined by the performer may be input as the reference tempo signal by the fret switch or the like. In this case, as in an acoustic instrument or the like, even when tempo information cannot be generated, the tempo information can be extracted.

A mode may also be made such that a sound processing system includes a decoding device which decodes the tempo information by using the above-described tempo information output device. The superimposing means of the tempo information output device superimpose pseudo noise on the audio signal with the timing based on the musical performance tempo to superimpose the tempo information. As pseudo noise, for example, a signal having high self-correlativity, such as a PN code, is used. The tempo information output device generates a signal having high self-correlativity with the timing based on the musical performance tempo (for example, for each beat), and superimposes the generated signal on the audio signal. Therefore, even when sound emission is made as an analog audio signal, there is no case where the superimposed tempo information is lost.

The decoding device includes input means to which the audio signal is input, and decoding means for decoding the tempo information. The decoding means calculates the correlation between the audio signal input to the input means and pseudo noise, and decodes the tempo information on the basis of the peak-generated timing of the correlation. Pseudo noise superimposed on the audio signal has extremely high self-correlativity. Thus, the decoding device calculates the correlation between the audio signal and pseudo noise, and the peak of the correlation is extracted for each beat timing. Therefore, the peak-generated timing of the correlation represents the musical performance tempo.

Even when pseudo noise having high self-correlativity, such as a PN code, is at low level, the peak of the correlation can be extracted. Thus, with respect to sound which has no discomfort for the sense of hearing (sound which is scarcely heard), the tempo information can be superimposed and decoded with high accuracy. Further, if pseudo noise is superimposed only in a high band equal to or higher than 20 kHz, pseudo noise can be further scarcely heard.

The invention may be configured such that the tempo information extracting means extracts multiple kinds of tempo information (for example, beat timing and bar timing) in accordance with each timing of the musical performance tempo, and the superimposing means superimposes multiple kinds of pseudo noise to superimpose the multiple kinds of tempo information. In this case, the decoding means of the decoding device calculates the correlation between the audio signal input to the input means and the multiple kinds of pseudo noise, and decodes the multiple kinds of tempo information on the basis of the peak-generated timing of the respective correlations. That is, if different patterns of pseudo noise are superimposed with the beat timing and the bar timing, there is no interference between pseudo noise, and the beat timing and the bar timing can be individually superimposed and decoded with high accuracy.

When tempo information is superimposed using pseudo noise, the tempo information output device may encode the M-series pseudo noise (PN code) through phase modulation with the tempo information. The frequency band on which the tempo information is superimposed is desirably an inaudible range equal to or higher than 20 kHz, but in the configuration in which an inaudible range is not used due to D/A conversion, encoding of compressed audio, or the like, for example, the tempo information is superimposed on the high-frequency band equal to or higher than 15 kHz, reducing the effect for the sense of hearing.

Fourth Embodiment

Figure 14:
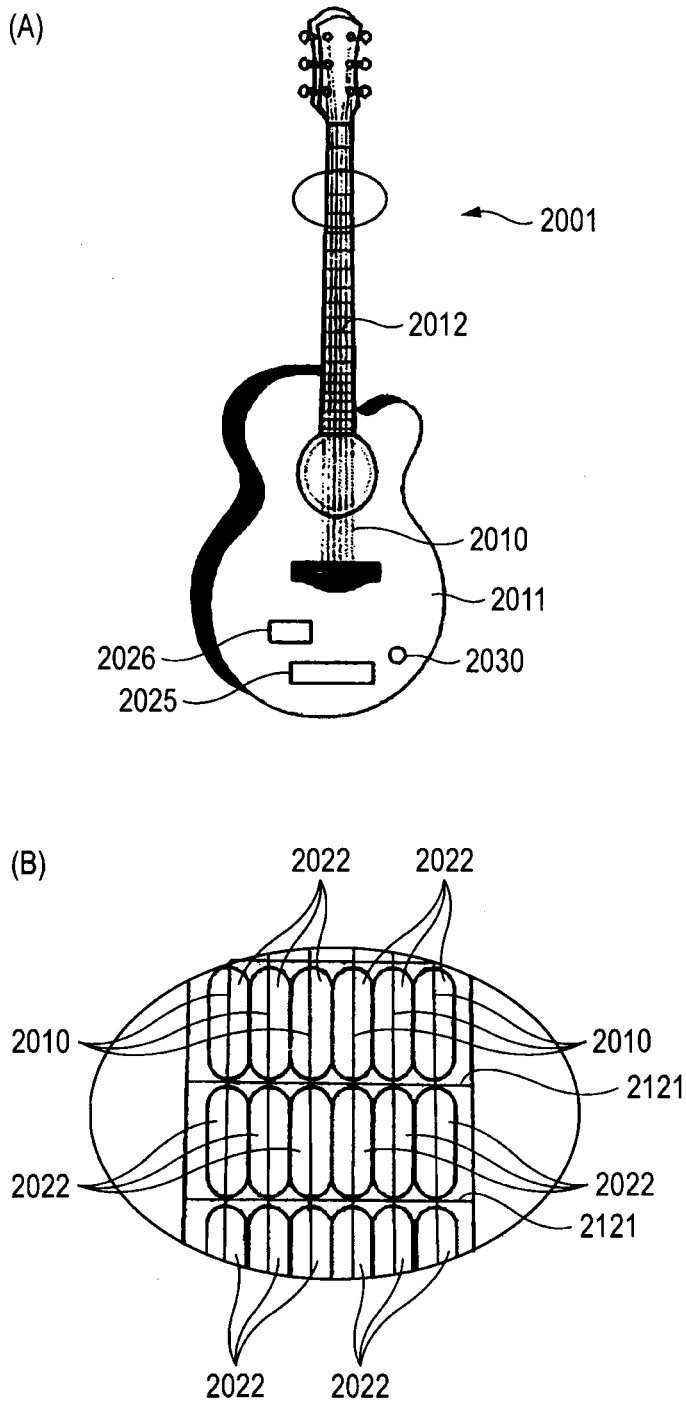
FIG. 14 is an appearance diagram showing the appearance of a guitar according to a fourth embodiment of the invention.
Figure 15:
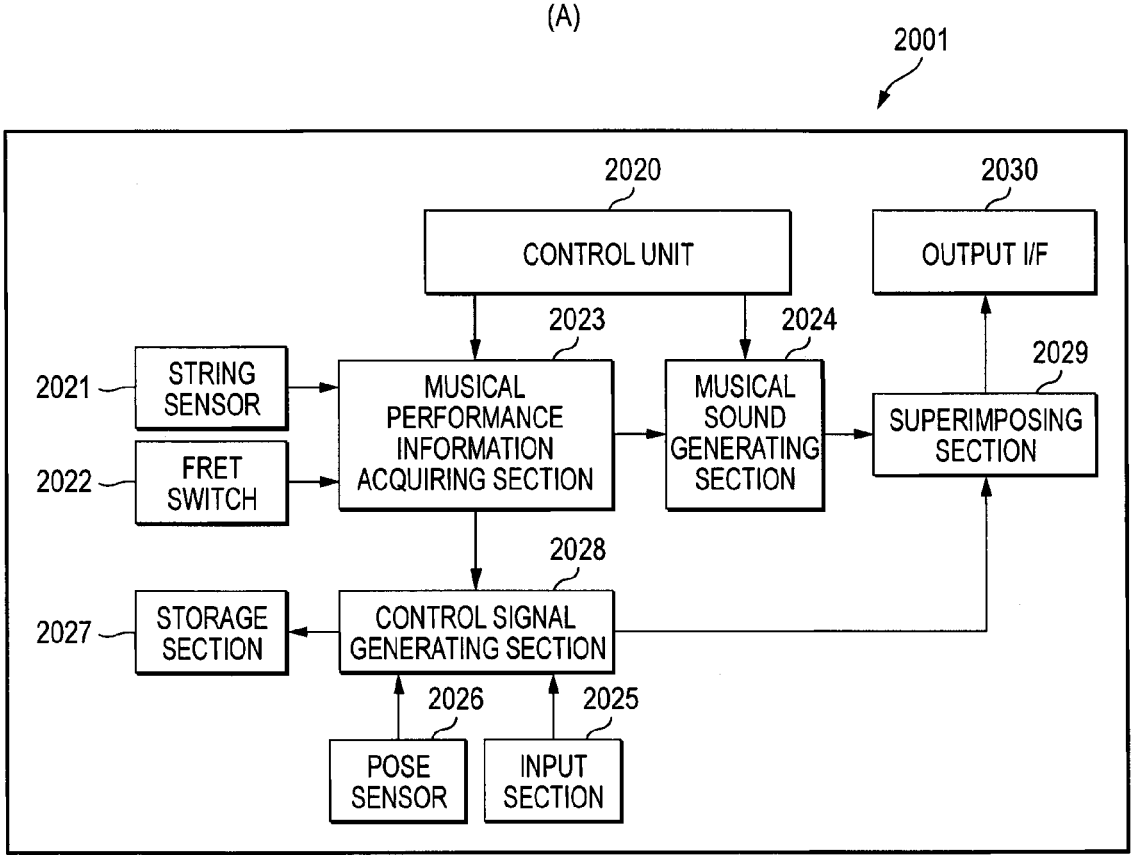
FIG. 15 is a block diagram showing the function and configuration of the guitar according to the fourth embodiment.
Figure 16:
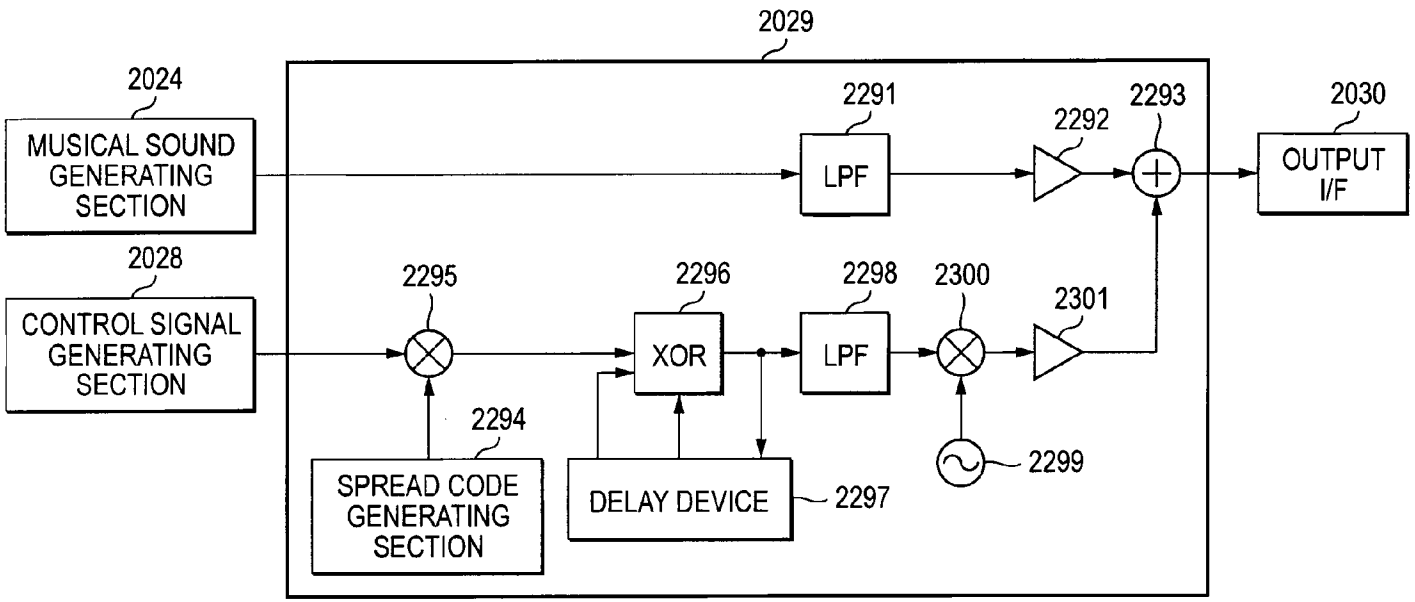
FIG. 16 shows an example of a control signal database according to the fourth embodiment.

A MIDI guitar 2001 which is an electronic stringed instrument according to a fourth embodiment of the invention will be described with reference to FIGS. 14 and 15. FIG. 14 is an appearance diagram showing the appearance of a guitar. In FIG. 14, (A) is a top view of the appearance of a guitar when viewed from above. In FIG. 14, (B) is a partial enlarged view of a neck of a guitar. In FIG. 15, (A) is a block diagram showing the function and configuration of a guitar. FIG. 16 shows an example of a control signal database.

First, the appearance of a MIDI guitar (hereinafter, simply referred to as a guitar) 2001 will be described with reference to FIG. 14. As shown by (A) in FIG. 14, the guitar 2001 includes a body 2011 and a neck 2012.

The body 2011 is provided with six strings 2010 which are plucked in accordance with the playing styles of the guitar, and an output I/F 2030 which outputs an audio signal. The six strings 2010 are provided with string sensors 2021 (see (A) in FIG. 15 which detect the vibration of the strings 2010.

As shown by (B) in FIG. 14, the neck 2012 is provided with frets 2121 which divide the scales. Multiple fret switches 2022 are arranged between the frets 2121.

Next, the function and configuration of the guitar 2001 will be described with reference to (A) in FIG. 15. As shown by (A) in FIG. 15, the guitar 2001 includes a control unit 2020, a string sensor 2021, a fret switch 2022, a musical performance information acquiring section 2023, a musical sound generating section 2024, an input section 2025, a pose sensor 2026, a storage section 2027, a control signal generating section (control signal generating means and musical performance-related information acquiring means) 2028, a superimposing section 2029, and an output I/F 2030.

The control unit 2020 controls the musical performance information acquiring section 2023 and the musical sound generating section 2024 on the basis of volume or tone set in the guitar 2001.

The string sensor 2021 includes a piezoelectric sensor or the like. The string sensor 2021 generates a waveform signal which is obtained by converting the vibration of the corresponding string 2010 to a waveform, and outputs the waveform signal to the musical performance information acquiring section 2023.

The fret switch 2022 detects the switch-on/off, and outputs a detection signal indicating the switch-on/off to the musical performance information acquiring section 2023.

The musical performance information acquiring section 2023 acquires fingering information indicating the positions of the fingers of the performer on the basis of the detection signal from the fret switch 2022. Specifically, the musical performance information acquiring section 2023 acquires a note number associated with the fret switch 2022, which inputs the detection signal, and note-on (switch-on) and note-off (switch-off) of the note number.

The musical performance information acquiring section 2023 acquires stroke information indicating the intensity of a stroke on the basis of the waveform signal from the string sensor 2021. Specifically, the musical performance information acquiring section 2023 acquires the velocity (intensity of sound) at the time of note-on.

The musical performance information acquiring section 2023 generates musical performance information (MIDI message) indicating the musical performance manipulation of the performer on the basis of the acquired fingering information and stroke information, and outputs the musical performance information to the musical sound generating section 2024 and the control signal generating section 2028. The musical performance information output to the control signal generating section 2028 is not limited to the MIDI message, and data in any format may be used.

The musical sound generating section 2024 includes a sound source, generates an audio signal in an analog format on the basis of the musical performance information input from the musical performance information acquiring section 2023, and outputs the audio signal to the superimposing section 2029.

The input section 2025 receives the input of a manipulation for controlling an external apparatus, and outputs manipulation information according to the manipulation to the control signal generating section 2028. Then, the control signal generating section 2028 generates a control signal according to the manipulation information from the input section 2025, and outputs the control signal to the superimposing section 2029.

The pose sensor 2026 outputs pose information generated through detection of the pose of the guitar 2001 to the control signal generating section 2028. For example, the pose sensor 2026 generates pose information (upper) if the neck 2012 turns upward with respect to the body 2011, generates pose information (left) if the neck 2012 turns left with respect to the body 2011, and generates pose information (upward left) if the neck 2012 turns upward left with respect to the body 2011.

The storage section 2027 stores a control signal database (hereinafter, referred to as a control signal DB) shown in FIG. 16. The control signal DB is referenced by the control signal generating section 2028. The control signal DB is configured such that specific musical performance information (for example, on/off of a specific fret switch 2022) for controlling the external apparatus or specific pose information of the guitar 2001 is made as a database. The control signal DB stores the specific musical performance information or pose information in association with a control signal for controlling the external apparatus.

The control signal generating section 2028 acquires a control signal for controlling the external apparatus from the storage section 2027 on the basis of the musical performance information from the musical performance information acquiring section 2023 and the pose information from the pose sensor 2026, and outputs the control signal to the superimposing section 2029.

The superimposing section 2029 superimposes the control signal input from the control signal generating section 2028 on the audio signal input from the musical sound generating section 2024, and outputs the resultant audio signal to the output I/F 2030. For example, the superimposing section 2029 phase-modulates a high-frequency carrier signal with the control signal (data code string of 0 and 1), such that the frequency component of the control signal is included in a band different from the frequency component (acoustic signal component) of the audio signal. A spread spectrum as described below may be used.

In FIG. 15, (B) is a block diagram showing an example of the configuration of the superimposing section 2029 when a spread spectrum is used. Although in (B) of FIG. 15, only digital signal processing has been described, the signals which are output to the outside may be analog signals (analog-converted signals).

In this example, the M-series pseudo noise code (PN code) output from the spread code generating section 2294 and the control signal (as a data code string of 0 and 1) are multiplied by a multiplier 2295 to spread the spectrum of the control signal. The spread control signal is input to an XOR circuit 2296. The XOR circuit 2296 outputs an exclusive OR of the code input from the multiplier 2295 and the output code before one sample input through a delay device 2297 to differentially encode the spread control signal. The differentially-encoded signal is binarized with −1 and 1. The differential code binarized with −1 and 1 is output, such that the spread control information can be extracted on the decoding side by multiplying the differential codes of two consecutive samples.

The differentially encoded control signal is band-limited to the baseband in an LPF (Nyquist filter) 2298 and input to a multiplier 2300. The multiplier 2300 multiplies a carrier signal (a carrier signal in a band higher than the acoustic signal component) output from a carrier signal generator 2299 and an output signal of the LPF 2298, and frequency-shifts the control differentially-encoded signal to the pass-band. The control differentially-encoded signal may be up-sampled and then frequency-shifted. The frequency-shifted control signal is regulated in gain by a gain regulator 2301, is mixed with the audio signal by an adder 2293, and is output to the output I/F 2030.

The audio signal output from the musical sound generating section 2024 is subjected to pass-band cutting in an LPF 2291, is regulated in gain by the gain regulator 2292, and is then input to the adder 2293. However, the LPF 2291 is not essential, the acoustic signal component and the component of the modulated signal (the frequency component of the superimposed control signal) do not have to be completely band-divided. For example, if the carrier signal is about 20 to 25 kHz, even when the acoustic signal component and the component of the modulated signal slightly overlap each other, it is difficult for the listener to listen to the modulated signal, and the SN ratio can be secured such that the control signal can be decoded. The frequency band on which the control signal is superimposed is desirably an inaudible range equal to or higher than 20 kHz, but in the configuration in which the inaudible range is not used due to D/A conversion, encoding of compressed audio, or the like, for example, the control signal is superimposed on a high-frequency band equal to or higher than 15 kHz, reducing the effect for the sense of hearing.

The audio signal on which the control signal is superimposed in the above-described manner is output from the output I/F 2030 which is an audio output terminal. The output I/F 2030 outputs the audio signal input from the superimposing section 2029 to an effects unit 2061 (see FIG. 17).

Figure 17:
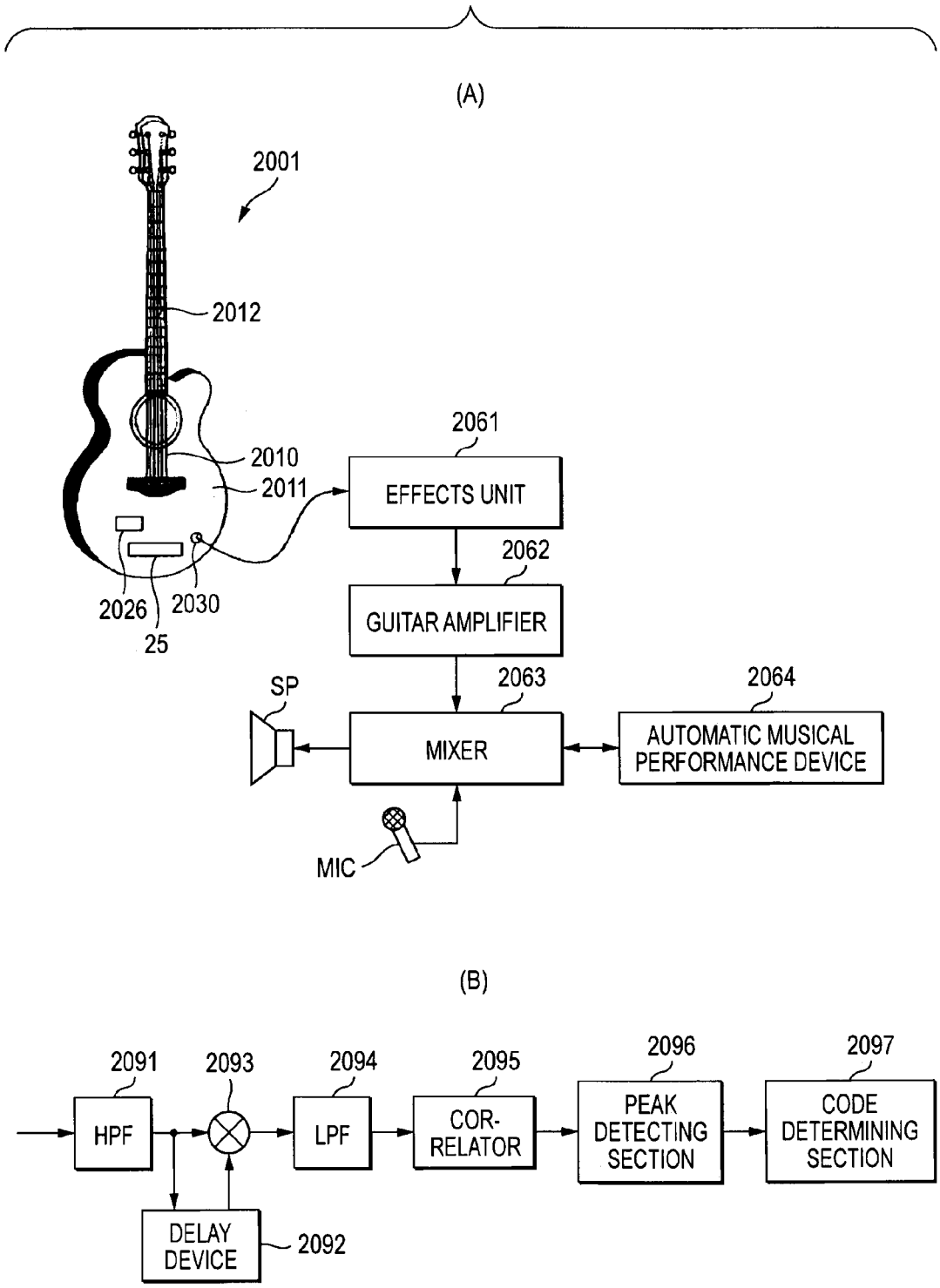
FIG. 17 is an explanatory view showing an example of a musical performance environment of the guitar according to the fourth embodiment.

Next, the control of the external apparatus by the musical performance or the like of the guitar 2001 will be described with reference to FIG. 17. FIG. 17 is an explanatory view showing an example of a musical performance environment of a guitar. As shown by (A) in FIG. 17, the guitar 2001 is sequentially connected to an effects unit 2061 which regulates a sound effect, a guitar amplifier 2062 which amplifies the volume of musical performance sound of the guitar 2001, a mixer 2063 which mixes input sound (musical performance sound of the guitar 2001, sound collected by a microphone MIC, and sound reproduced by an automatic musical performance device 2064), and a speaker SP. The microphone MIC which collects sound of a vocalist, and the automatic musical performance device 2064 which carries out an automatic musical performance of MIDI data provided therein are connected to the mixer 2063.

At least one of the external apparatuses shown by (A) in FIG. 17 including the effects unit 2061, the guitar amplifier 2062, the mixer 2063, and the automatic musical performance device 2064 includes a decoding section, and decodes the control signal superimposed on the audio signal. The decoding method varies depending on the superimposing method of the control signal in the superimposing section 2029. When the above-described spread spectrum is used, decoding is carried out as follows.

In FIG. 17, (B) is a block diagram showing an example of the configuration of the decoding section. The audio signal input to the decoding section is input to an HPF 2091. The HPF 2091 is a filter for removing the acoustic signal component. An output signal of the HPF 2091 is input to a delay device 2092 and a multiplier 2093. The delay amount of the delay device 2092 is set to the time for one sample of the differential code. When the differential code is up-sampled, the delay amount is set to the time for one sample after up-sampling. The multiplier 2093 multiplies the signal input from the HPF 2091 and the signal before one sample output from the delay device 2092, and carries out delay detection processing. The differentially encoded signal is binarized with −1 and 1, and indicates the phase change from the code before one sample. Thus, with multiplication by the signal before one sample, the control signal information before differential encoding (the spread code) is extracted.

An output signal of the multiplier 2093 is extracted as a baseband signal through an LPF 2094 which is a Nyquist filter, and input to a correlator 2095. The correlator 2095 calculates the correlation with an input signal with the same spread code as the spread code output from the spread code generating section 2294. A PN code having high self-correlativity is used for the spread code. Thus, with regard to a correlation value output from the correlator 2095, the positive and negative peak components are extracted by a peak detecting section 2096 in the period of the spread code (the period of the data code). A code determining section 2097 decodes the respective peak components as the data code (0,1) of the control signal. In this way, the control signal superimposed on the audio signal is decoded. The decoded control signal is used to control the respective external apparatuses. The differential encoding processing on the superimposing side and the delay detection processing on the decoding side are not essential.

For example, in (A) of FIG. 17, if the string sensor 2021 does not detect the vibration of the string 2010, and the fret switch 2022 detects that the first to sixth strings of the first fret are depressed, the guitar 2001 acquires a control signal, which instructs the start of the musical performance of the automatic musical performance device 2064, from the control signal DB (see FIG. 16). The guitar 2001 superimposes the control signal on the audio signal and outputs the resultant audio signal. The automatic musical performance device 2064 acquires the control signal to start the musical performance of the automatic musical performance device 2064. As described above, it is possible to make the automatic musical performance device 2064, which is an external apparatus, start the musical performance in accordance with the musical performance manipulation of the guitar 2001 (a musical performance manipulation which does not generate an audio signal). In this case, the decoding section may be embedded in the automatic musical performance device 2064, and the audio signal on which the control signal is superimposed may be input to the automatic musical performance device 2064, such that the automatic musical performance device 2064 may decode the control signal. Alternatively, the decoding section may be embedded in the mixer 2063, the mixer 2063 may decode the control signal, and the decoded control signal may be input the automatic musical performance device 2064.

If the pose sensor 2026 detects that the neck 2012 turns downward with respect to the body 2011 immediately after the neck 2012 turns upward with respect to the body 2011, the guitar 2001 acquires a control signal, which instructs stoppage of the musical performance of the automatic musical performance device 2064, from the control signal DB (see FIG. 16). The guitar 2001 superimposes the control signal on the audio signal and outputs the resultant audio signal. The automatic musical performance device 2064 acquires the control signal to stop the musical performance of the automatic musical performance device 2064. As described above, it is possible to make the automatic musical performance device 2064, which is an external apparatus, stop the musical performance in accordance with the pose of the guitar 2001 (that is, the gestural musical performance of the performer using the guitar 2001).

If the pose sensor 2026 detects that the neck 2012 turns upward with respect to the body 2011 and the string sensor 2021 detects the vibration of the string 2010, the guitar 2001 acquires a control signal, which instructs the mixer 2063 to turn up the volume of the guitar, from the control signal DB (see FIG. 16). The guitar 2001 superimposes the control signal on the audio signal and outputs the resultant control signal. The mixer 2063 acquires the control signal and turns up the volume of the guitar. As described above, it is possible to make the mixer 2063, which is an external apparatus, regulate the volume at the time of synthesis in accordance with the combination of the pose of the guitar 2001 (that is, the gestural musical performance of the performer using the guitar 2001) and the musical performance manipulation of the guitar 2001.

If the fret switch 2022 detects that a specific fret (the second string and the fifth fret, and the third string and the sixth fret) is depressed, and the string sensor 2021 detects the vibration of the string 2010, the guitar 2001 acquires a control signal, which instructs the effects unit 2061 to change an effect, from the control signal DB (see FIG. 16). The guitar 2001 superimposes the control signal on the audio signal and outputs the resultant audio signal. The effects unit 2061 acquires the control signal and changes the effect. As described above, it is possible to make the effects unit 2061, which is an external apparatus, change the effect in accordance with the musical performance manipulation of the guitar 2001 (a musical performance manipulation which generates an audio signal).

The above-described contents are an example, and the guitar 2001 registers a control signal for controlling an external apparatus in the control signal DB, and can control an acoustic-related device, such as the effects unit 2061 or the guitar amplifier 2062, or a stage-related device, such as an illumination or a camera, as an external apparatus. Thus, the external apparatus (the automatic musical performance device 2064, the mixer 2063, or the like) can be controlled in accordance with the gestural musical performance of the performer using the guitar 2001 or the musical performance manipulation of the guitar 2001.

The association of the control signal stored in the control signal DB and the musical performance information or the pose information may be edited. In this case, the guitar 2001 is provided with a control signal input section (not shown in figure), such that the performer registers a control signal for controlling an external apparatus in the control signal DB. The performer conducts a musical performance or a gestural musical performance, and the musical performance information acquiring section 2023 acquires the musical performance information or the pose information and registers the musical performance information or the pose information in the control signal DB in association with the registered control signal. Thus, the performer can easily register a control signal in accordance with his/her purpose.

Instead of the control signal DB, a control signal DB may be provided in which specific musical performance information or pose information and the reception period in which the input of the specific musical performance information or pose information is received are stored in association with the control signal. FIG. 18 shows another example of the control signal database. In this case, the guitar 2001 includes a measuring section (not shown) which measures the elapsed time (or the number of beats) after the musical performance has started. For example, if, in one to two minutes after the musical performance has started, the pose sensor 2026 detects that the neck 2012 turns upward with respect to the body 2011, and the string sensor 2021 detects the vibration of the string 2010, the guitar 2001 acquires a control signal, which instructs the mixer 2063 to turn up the volume of the guitar, from the control signal DB shown in FIG. 18. In a period out of one to two minutes after the musical performance has started, even when the gesture is detected, the guitar 2001 does not acquire a control signal, thus the mixer 2063 is not manipulated.

For example, if, in the eighth to the tenth beat or the fourteenth beat to the twentieth beat after the musical performance has started, the fret switch 2022 detects that the second string of the fifth fret and the third string of the sixth fret are depressed, and the string sensor 2021 detects the vibration of the string 2010, the guitar 2001 acquires a control signal, which instructs the effects unit 2061 to change the effect, from the control signal DB. In a period out of the eighth beat to the tenth beat or the fourteenth beat to the twentieth beat after the musical performance has started, even when the gesture is detected, the guitar 2001 does not acquire a control signal, thus the effects unit 2061 is not manipulated.

As described above, an external apparatus can be controlled in accordance with the combination of the musical performance manipulation of the guitar 2001 (musical performance information) or the gestural musical performance of the performer using the guitar 2001 (pose information) and the reception period (the elapsed time or the number of beats after the musical performance has started). Therefore, the performer can easily control different external apparatuses with the same musical performance manipulation in accordance with the elapsed time. The guitar 2001 can control an external apparatus (for example, the effects unit 2061 or the guitar amplifier 2062) in accordance with the elapsed time, changing the effect or volume, thus it is appropriate to use when a musical piece is performed in which the tune changes with the elapsed time.

Although in the fourth embodiment, the guitar 2001 has been described as an example, an electronic musical instrument, such as an electronic piano or a MIDI violin, may be used.

Furthermore, the mixer 2063 may control an external apparatus on the basis of manipulation information, musical performance information, and pose information from multiple musical instruments. For example, the guitar 2001 superimposes musical performance information indicating the musical performance manipulation of the guitar 2001 or pose information indicating the gestural musical performance of the performer using the guitar 2001 on the audio signal, and outputs the resultant audio signal to the mixer 2063. Similarly, the microphone MIC superimposes pose information (the pose of the microphone MIC) indicating the gestural musical performance of the vocalist using the microphone MIC on uttered sound and outputs resultant uttered sound to the mixer 2063. The mixer 2063 controls the external apparatus on the basis of the musical performance information or the pose information acquired from the audio signal and uttered sound (for example, regulates the volume of sound emission from the speaker SP, changes the effect of the effects unit 2061, or changes the synthesis rate of the audio signal and uttered sound in the mixer 2063).

Although in the fourth embodiment, a control signal is generated on the basis of musical performance information, manipulation information, and pose information, a control signal may be generated on the basis of at least one of manipulation information, musical performance information, and pose information. In this case, as necessary, the guitar 2001 may include the pose sensor 2026 or the input section 2025.

Fifth Embodiment

Figure 19:
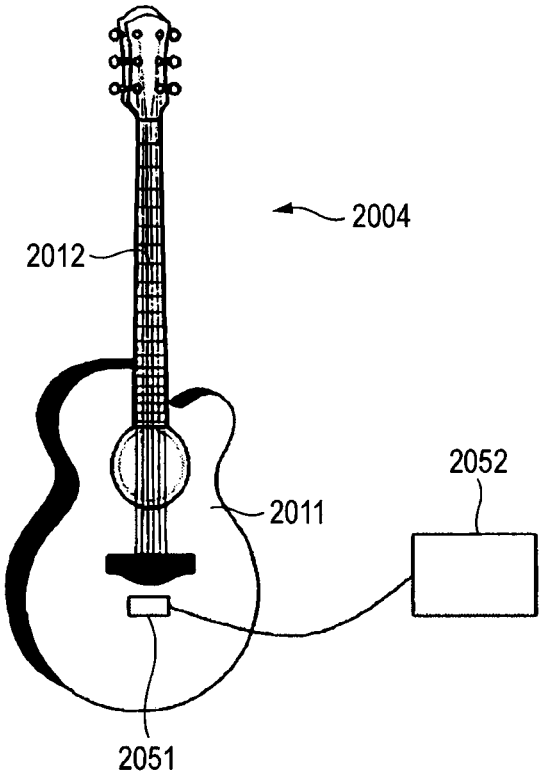
FIG. 19 is a top view of the appearance of a guitar with a control device according to a fifth embodiment of the invention when viewed from above.
Figure 20:
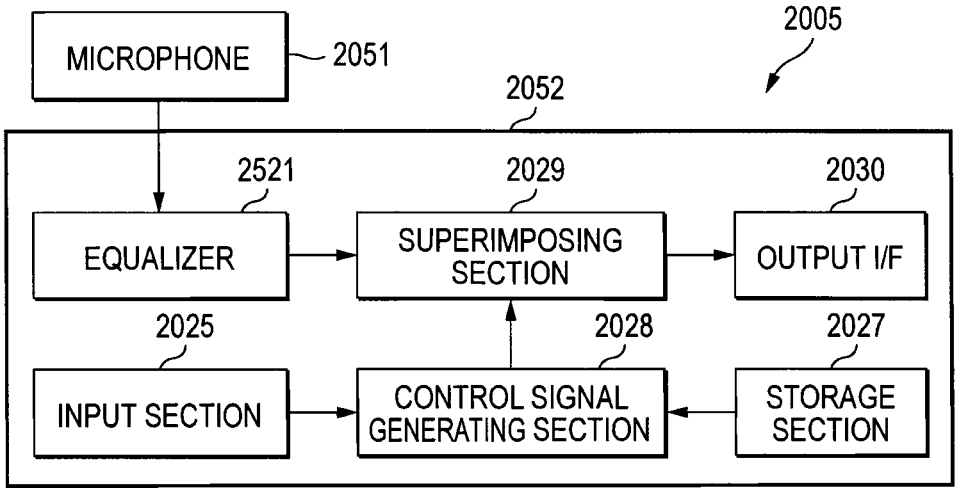
FIG. 20 is a block diagram showing the function and configuration of the control device according to the fifth embodiment.

A control device (musical performance-related information output device) 2005 according to a fifth embodiment of the invention will be described with reference to FIGS. 19 and 20. FIG. 19 is a top view of the appearance of a guitar with a control device when viewed from above. FIG. 20 is a block diagram showing the function and configuration of a control device. The fifth embodiment is different from the fourth embodiment in that an acoustic guitar (hereinafter, simply referred to as a guitar) 2004 which is an acoustic stringed instrument is provided with a control device 2005, superimposes a control signal for controlling an external apparatus on an audio signal from the guitar 2004, and outputs the resultant audio signal. The difference will be described.

As shown in FIG. 19, the control device 2005 is constituted of a microphone 2051 (corresponding to audio signal generating means of the invention) and a main body 2052. The microphone 2051 is provided in a body 2011 of the guitar 2004. As shown in FIG. 20, the main body 2052 is provided with an equalizer 2521, an input section 2025, a storage section 2027, a control signal generating section 2028, a superimposing section 2029, and an output I/F 2030. During the musical performance of the guitar 2004, the performer may carry the main body 2052 with him/her, or only the input section 2025 may be detached from the main body 2052 and the performer may carry only the input section 2025 with him/her. The storage section 2027, the control signal generating section 2028, the superimposing section 2029, and the output I/F 2030 have the same function and configuration as those in the fourth embodiment.

The microphone 2051 is, for example, a contact microphone for use in the pick-up or the like of a guitar or an electromagnetic microphone of an electric guitar. The contact microphone is a microphone which can be attached to the body of a musical instrument to cancel external noise and to detect not only the vibration of the string 2010 of the guitar 2004 but also the resonance of the guitar 2004. If power is turned on, the microphone 2051 collects not only the vibration of the string 2010 of the guitar 2004 but also the resonance of the guitar 2004 to generate an audio signal. Then, the microphone 2051 outputs the generated audio signal to the equalizer 2521.

The equalizer 2521 regulates the frequency characteristic of the audio signal input from the microphone 2051, and outputs the audio signal to the superimposing section 2029.

Thus, even in the case of the guitar 2004 which does not generate an audio signal, the microphone 2051 can generate an audio signal in accordance with the vibration of the string 2010 of the guitar 2004 or the resonance of the guitar 2004. Therefore, the control device 2005 can superimpose the control signal on the audio signal and output the resultant audio signal.

The control device 2005 may include the fret switch 2022 (or a depress sensor) which detects the on/off of the fret 2121 for acquiring the musical performance information of the guitar 2004, and the string sensor 2021 which detects the vibration of each string 2010. The control device 2005 may also include the pose sensor 2026 for acquiring the pose information of the guitar 2004.

Although in the fifth embodiment, the guitar 2004 has been described as an example, the invention is not limited thereto, and may be applied to an acoustic instrument, such as a grand piano (keyboard instrument) or a drum (percussion instrument). For example, in the case of a grand piano, the microphone 2051 is provided in the frame of the grand piano, and the control device 2005 generates an audio signal through sound collection of the microphone 2051. A pressure sensor which detects the on/off of each key and pressure applied to each key, or a switch which detects whether or not the pedal is stepped may be provided in the grand piano, and the control device 2005 can acquire the gestural musical performance of the performer using the grand piano or the musical performance manipulation of the grand piano.

For example, in the case of a drum, the microphone 2051 is provided around the drum, and the control device 2005 causes the microphone 2051 to collect emitted sound and generates an audio signal. The pose sensor 2026 which detects the stick stroke of the performer (detects the pose of the stick) or a pressure sensor which measures a force to beat the drum may be provided in the stick which beats the drum, and the control device 2005 may acquire the gestural musical performance of the performer using the drum or the musical performance manipulation of the drum.

The control device (musical performance-related information output device) receives a manipulation input for controlling an external apparatus (for example, an acoustic-related device, such as an effects unit, a mixer, or an automatic musical performance device, a stage-related device, such as an illumination or a camera, or the like). The control device generates a control signal, which controls the external apparatus, in accordance with the manipulation input. Then, the control device superimposes the control signal on the audio signal such that the modulated component of the control signal is included in a band higher than the frequency component of the audio signal generated in accordance with the musical performance manipulation, and outputs the resultant audio signal to the audio output terminal. For example, M-series pseudo noise (PN code) can be encoded through phase modulation with the control signal. The frequency band on which the control signal is superimposed is desirably an inaudible range equal to or higher than 20 kHz, but in the configuration in which an inaudible range is not used due to D/A conversion, encoding of compressed audio, or the like, for example, the control signal is superimposed on a high-frequency band equal to or higher than 15 kHz, reducing the effect for the sense of hearing.

Thus, the control device can output both the control signal and the audio signal from the single audio output terminal. The control device can easily control an external apparatus connected thereto only by outputting the audio signal on which the control signal is superimposed.

The control device of the invention is a musical instrument which receives, for example, the input of a musical performance manipulation (the on/off of the fret of the guitar, the vibration of the string, or the like) as a manipulation input for controlling an external apparatus. The control device includes storage means for storing the musical performance information indicating the musical performance manipulation and the control signal in association with each other. Then, the control device may be configured to acquire the control signal according to the input musical performance manipulation from the storage means.

Thus, the musical instrument which is the control device can control the external apparatus in accordance with its own musical performance manipulation during the musical performance. For example, during the musical performance, the performer may change the effect of the effects unit or may start the musical performance of the automatic musical performance device (for example, a karaoke or the like) by a musical performance manipulation. The external apparatus can be controlled in accordance with the musical performance manipulation, new input means does not have to be provided.

The control device of the invention may be configured to control an external apparatus in accordance with not only the musical performance manipulation but also the pose information by the pose sensor provided therein (the gestural musical performance of the performer).

Thus, the performer conducts a gestural musical performance, such as change in the direction of the control device to control an external apparatus, thus there is no case where an audio signal generated by a musical performance manipulation is affected in accordance with a musical piece being performed.

The control device of the invention includes measuring means for measuring the elapsed time or the number of beats after the musical performance has started. The control device stores the reception period, in which the input of a musical performance manipulation for controlling an external apparatus is received, in association with the control signal. The control device may be configured to acquire a control signal according to the musical performance manipulation from the storage means when the elapsed time measured by the measuring means falls within the reception period. For example, the effect of the effects unit is changed in a chorus section, or the volume of the mixer is turned up for the time of a solo musical performance.

Thus, the control device can control an external apparatus in accordance with the elapsed time after the musical performance has started, such that the performer can control different external apparatuses with the same manipulation in accordance with the elapsed time. In particular, the control device controls an external apparatus (for example, the effects unit or the guitar amplifier) in accordance with the elapsed time to change the effect or the volume, thus it is appropriate to use when a musical piece in which the tune changes with the elapsed time is performed.

The control device of the invention may include registering means for registering a manipulation for controlling an external apparatus and a control signal according to the manipulation in association with each other.

Thus, the performer registers a musical performance manipulation which appears with a specific timing or a musical performance manipulation with no effect on the audio signal generated by the musical performance manipulation in association with the control signal in advance in accordance with a musical piece to be performed. Then, the performer can control an external apparatus by conducting the registered musical performance manipulation. For example, the performer registers the control signal and a musical performance manipulation indicating the start of a solo musical performance in association with each other in advance. Then, if the performer conducts the solo musical performance, the control device can control a spotlight to focus the spotlight on the performer. Further, for example, the performer registers the control signal and a musical performance manipulation, which does not appear in a musical piece to be performed, in association with each other in advance. Then, if the performer conducts the registered musical performance manipulation such that an audio signal according to the musical performance manipulation is not generated between musical pieces, the control device can control the effects unit to change the sound effect.

The control device of the invention includes audio signal generating means having a pick-up or an acoustic microphone, and the audio signal generating means generates an audio signal on the basis of the vibration or resonance of the control device. Then, the control device may be configured to superimpose the control signal on the generated audio signal and to output the resultant audio signal.

Therefore, the control device may be attached to the existing musical instrument (for example, an acoustic guitar, a grand piano, a drum, or the like) later for use.

Sixth Embodiment

Figure 21:
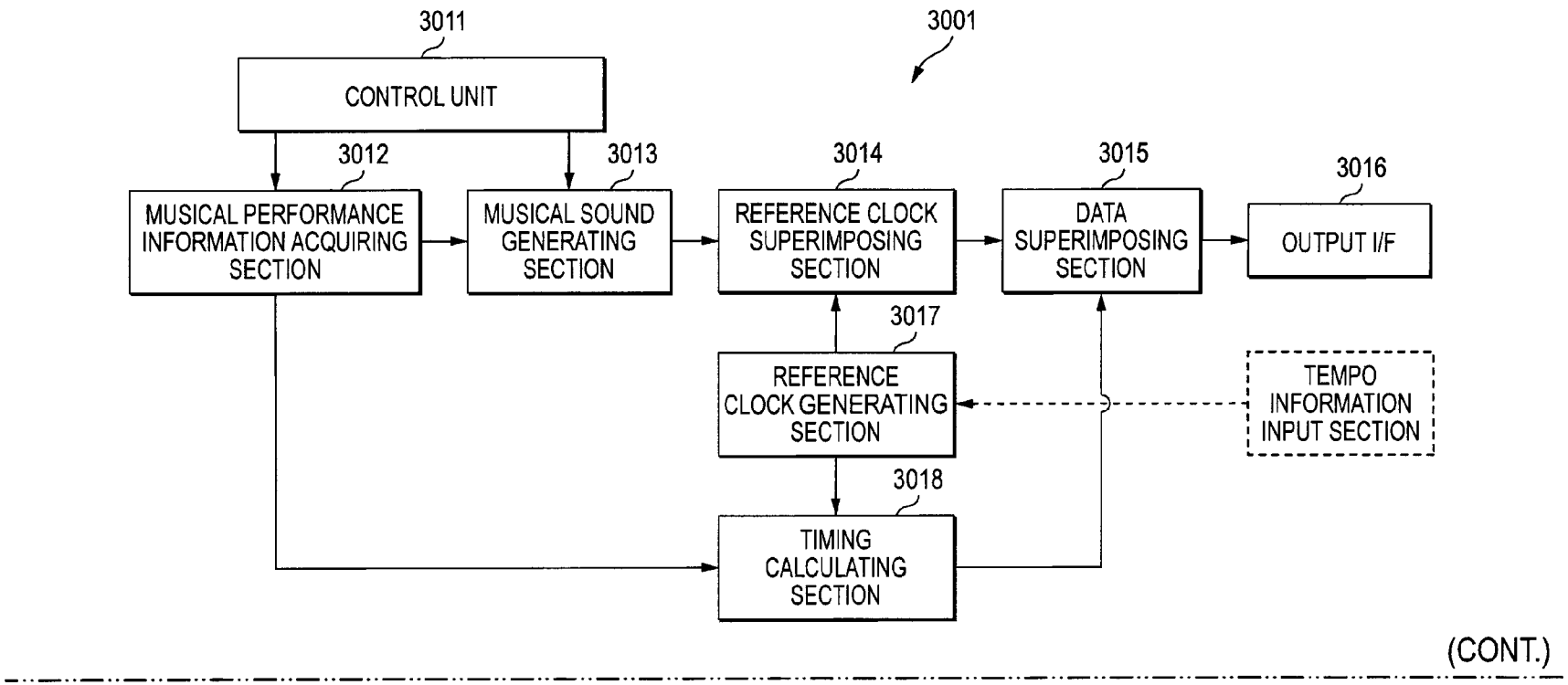
FIG. 21 shows the configuration of a sound processing system according to a sixth embodiment of the invention.

FIG. 21 shows the configuration of a sound processing system according to a sixth embodiment of the invention. The sound processing system includes a sequence data output device and a decoding device. In FIG. 21, (A) shows an example where an electronic musical instrument (electronic piano) also servers as a device which outputs tempo information, which becomes a reference clock. In this embodiment, an example will be described where musical performance information as sequence data is superimposed on an audio signal.

An electronic piano 3001 shown by (A) in FIG. 21 includes a control unit 3011, a musical performance information acquiring section 3012, a musical sound generating section 3013, a reference clock superimposing section 3014, a data superimposing section 3015, an output interface (I/F) 3016, a reference clock generating section 3017, and a timing calculating section 3018. The reference clock superimposing section 3014 and the data superimposing section 3015 may be collectively and simply called a superimposing section.

The musical performance information acquiring section 3012 acquires musical performance information in accordance with a musical performance manipulation of the performer. The acquired musical performance information is output to the musical sound generating section 3013 and the timing calculating section 3018. The musical performance information is, for example, information of depressed keys (note number), the key depressing timing (note-on and note-off), the key depressing speed (velocity), or the like. The control unit 3011 instructs which musical performance information is output (on the basis of which musical performance information musical sound is generated).

The musical sound generating section 3013 has an internal sound source, and receives the musical performance information from the musical performance information acquiring section 3012 in accordance with the instruction of the control unit 3011 (setting of volume or the like) to generate musical sound (audio signal).

The reference clock generating section 3017 generates a reference clock according to a set tempo. When a tempo clock is used as the reference clock, the tempo clock is, for example, a clock which is based on a MIDI clock (24 clocks per quarter notes), and is constantly output. The reference clock generating section 3017 outputs the generated reference clock to the reference clock superimposing section 3014 and the timing calculating section 3018.

A metronome sound generating section which generates metronome sound in accordance with the tempo clock may be provided, and metronome sound may be mixed with musical sound by the musical performance and output from a headphone I/F or the like. In this case, the performer can conduct the musical performance while listening to metronome sound (tempo) heard from the headphone.

A manipulator for tempo information input only (a tempo information input section indicated by a broken line in the drawing, such as a tap switch) may be provided in the electronic piano 3001 to input the beat defined by the performer as a reference tempo signal and to extract the tempo information.

The reference clock superimposing section 3014 superimposes the reference clock on the audio signal input from the musical sound generating section 3013. As the superimposing method, a method is used in which a superimposed signal is scarcely heard. For example, pseudo noise, such as a PN code (M series), is superimposed at a weak level with no discomfort on the sensor of hearing. At this time, the band on which pseudo noise is superimposed may be limited to an out-of-audibility (equal to or higher than 20 kHz) band. In the configuration in which an inaudible range is not used due to D/A conversion, encoding of compressed audio, or the like, for example, even in a high-frequency band equal to or higher than 15 kHz, it is possible to reduce the effect for the sense of hearing. Pseudo noise, such as M series, has extremely high self-correlativity. Thus, the correlation between the audio signal and the same code as superimposed pseudo noise is calculated on the decoding side, such that the reference clock can be extracted. The invention is not limited to M series, and another random number, such as Gold series, may be used.

The reference clock extraction processing on the decoding side will be described with reference to (B) in FIG. 21 and (C) in FIG. 21. A decoding device 3002 shown by (B) in FIG. 21 has a function as a recorder for recording an audio signal, a function as a reproducer for reproducing an audio signal, and a function as a decoder for decoding a reference clock superimposed on an audio signal. Here, with regard to the decoding device 3002 shown by (B) in FIG. 21, the function for decoding a reference clock superimposed on an audio signal will be mainly described.

In (B) of FIG. 21, the decoding device 3002 includes an input I/F 3021, a control unit 3022, a storage section 3023, a reference clock extracting section 3024, and a timing extracting section 3025. The control unit 3022 records an audio signal input from the input I/F 3021, and records the audio signal in the storage section 3023 as general-used audio data. The control unit 3022 also reads audio data recorded in the storage section 3023 and outputs audio data to the reference clock extracting section 3024.

The reference clock extracting section 3024 generates the same pseudo noise as pseudo noise generated by the reference clock superimposing section 3014 of the electronic piano 3001, and calculates the correlation with the reproduced audio signal. Pseudo noise superimposed on the audio signal has extremely high self-correlativity. Thus, if the correlation between the audio signal and pseudo noise is calculated, as shown by (C) in FIG. 21, a steep peak is extracted regularly. The peak-generated timing of the correlation represents the reference clock.

When the tempo information is used as the reference clock, multiple kinds of pseudo noise may be superimposed with beat timing and bar timing, such that the beat timing and the bar timing may be discriminated on the decoding side. In this case, multiple tempo clock extracting sections for beat timing extraction and bar timing extraction may be provided. If different patterns of pseudo noise are superimposed with the beat timing and the bar timing, there is no interference between pseudo noise, and the beat timing and the bar timing can be individually superimposed and decoded with high accuracy.

The reference clock extracted in the above-described manner can be used for an automatic musical performance by a sequencer insofar as the reference clock is based on the tempo information, such as the MIDI clock. For example, an automatic musical performance in which the sequencer reflects its own musical performance tempo can be realized.

In (A) of FIG. 21, each time the reference clock is input from the reference clock generating section 3017, the reference clock superimposing section 3014 generates pseudo noise having a predetermined length, superimposes pseudo noise on the audio signal, and outputs the resultant audio signal to the data superimposing section 3015. The timing calculating section 3018 acquires the musical performance information from the musical performance information acquiring section 3012, and outputs the musical performance information to the data superimposing section 3015.

The data superimposing section 3015 superimposes the musical performance information on the audio signal input from the reference clock superimposing section 3014. At this time, the timing calculating section 3018 calculates the time difference between the reference clock and the timing of superimposing the musical performance information in the data superimposing section 3015, and outputs information regarding the time difference to the data superimposing section 3015 together with the musical performance information. The information regarding the time difference is represented by the difference (offset value) from the reference clock. The timing calculating section 3018 converts the musical performance information and the offset value in a predetermined data format such that the musical performance information and the offset value can be superimposed on the audio signal, and outputs the musical performance information and the offset value to the data superimposing section 3015 (see (A) in FIG. 22).

The data superimposing section 3015 superimposes the musical performance information and the offset value input from the timing calculating section 3018 on the audio signal. With regard to the superimposing method, a high-frequency carried signal is phase-modulated with the musical performance information or the offset value (as a data code string of 0 and 1), such that the modulated component is included in a band different from the frequency component (acoustic signal component) of the audio signal. The following spread spectrum may also be used.

Figure 25:
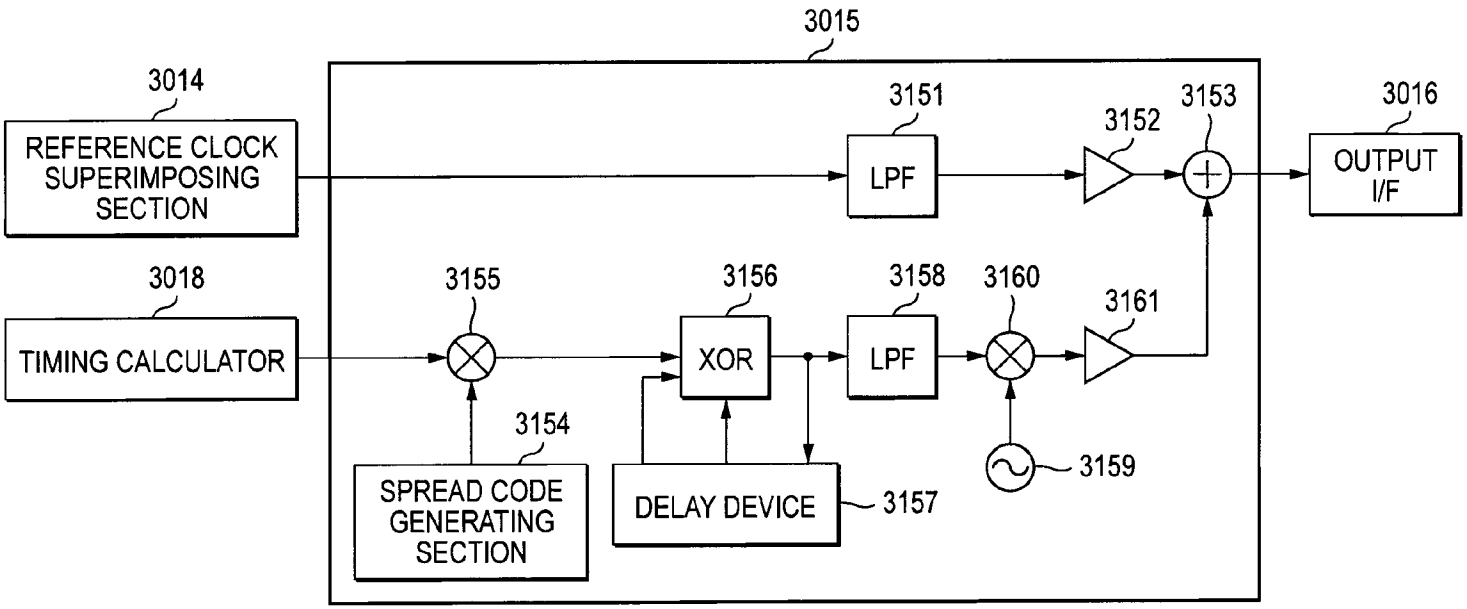
FIG. 25 shows the configuration of a data superimposing section and a timing calculating section according to the sixth embodiment.

In FIG. 25, (A) is a block diagram showing an example of the configuration of the data superimposing section 3015 when a spread spectrum is used. Although in (A) of FIG. 25, only digital signal processing has been described, the signals which are output to the outside may be analog signals (analog-converted signals).

In this example, an M-series pseudo noise code (PN code) output from a spread code generating section 3154, the musical performance information, and the offset value (data code string of 0 and 1) are multiplied by a multiplier 3155 to spread the spectrum of the data code string. The spread data code string is input to an XOR circuit 3156. The XOR circuit 3156 outputs an exclusive OR of the code input from the multiplier 3155 and the output code before one sample input through a delay device 3157 to differentially encode the spread data code string. It is assumed that the differentially-encoded signal is binarized with −1 and 1. The differential code binarized with −1 and 1 is output, such that the spread data code string can be extracted on the decoding side by multiplying the differential codes of two consecutive samples.

The differentially encoded data code string is band-limited to the baseband in an LPF (Nyquist filter) 3158 and input to a multiplier 3160. The multiplier 3160 multiplies a carrier signal (a carrier signal in a band higher than the acoustic signal component) output from a carrier signal generator 3159 and an output signal of the LPF 3158, and frequency-shifts the differentially-encoded data code string to the pass-band. The differentially-encoded data code string may be up-sampled and then frequency-shifted. The frequency-shifted data code string is regulated in gain by a gain regulator 3161, is mixed with the audio signal by an adder 3153, and is output to the output I/F 3016.

The audio signal output from the reference clock superimposing section 3014 is subjected to pass-band cutting in an LPF 3151, is regulated in gain by a gain regulator 3152, and is then input to the adder 3153. However, the LPF 3151 is not essential, and the acoustic signal component and the component of the modulated signal (the frequency component of the superimposed data code string) do not have to be completely band-divided. For example, if the carrier signal is about 20 to 25 kHz, even when the acoustic signal component and the component of the modulated signal slightly overlap each other, it is difficult for the listener to listen to the modulated signal, and the SN ratio can be secured such that the data code string can be decoded. The frequency band on which the data code string is superimposed is desirably an inaudible range equal to or higher than 20 kHz, but in the configuration in which the inaudible range is not used due to D/A conversion, encoding of compressed audio, or the like, for example, the data code string is superimposed on a high-frequency band equal to or higher than 15 kHz, reducing the effect for the sense of hearing.

In this way, the audio signal on which the data code string (musical performance information and offset value) and the reference clock are superimposed is output from the output I/F 3016 which is an audio output terminal.

As described above, in the decoding device 3002, the reference clock extracting section 3024 decodes the reference clock, and the timing extracting section 3025 decodes the musical performance information and the offset value superimposed on the audio signal. When the above-described spread spectrum is used, decoding is as follows.

In FIG. 25, (B) is a block diagram showing an example of the configuration of the timing extracting section 3025. The audio signal input to the timing extracting section 3025 is input to an HPF 3251. The HPF 3251 is a filter which removes the acoustic signal component. An output signal of the HPF 3251 is input to a delay device 3252 and a multiplier 3253. The delay amount of the delay device 3252 is set to the time for one sample of the differential code. When the differential code is up-sampled, the delay amount is set to the time for one sample after up-sampling. The multiplier 3253 multiplies the signal input from the HPF 3251 and the signal before one sample output from the delay device 3252 and carries out delay detection processing. The differentially encoded signal is binarized with −1 and 1, and indicates the phase change from the code before one sample. Thus, with multiplication by the signal before one sample, the musical performance information and the offset value before differential encoding (spread code) are extracted.

An output signal of the multiplier 3253 is extracted as a baseband signal through an LPF 3254 which is a Nyquist filter, and is input to a correlator 3255. The correlator 3255 calculates the correlation with an input signal with the same spread code as the spread code output from the spread code generating section 3254. A PN code having high self-correlativity is used for the spread code. Thus, with regard to a correlation value output from the correlator 3255, the positive and negative peak components are extracted by a peak detecting section 3256 in the period of the spread code (the period of the data code). A code determining section 3257 decodes the respective peak components as the data code (0,1) of the musical performance information and the offset value. In this way, the musical performance information and the offset value superimposed on the audio signal are decoded. The differential encoding processing on the superimposing side and the delay detection processing on the decoding side are not essential. The reference clock may also be superimposed on the audio signal through phase modulation of the spread code with the reference clock.

Figure 22:
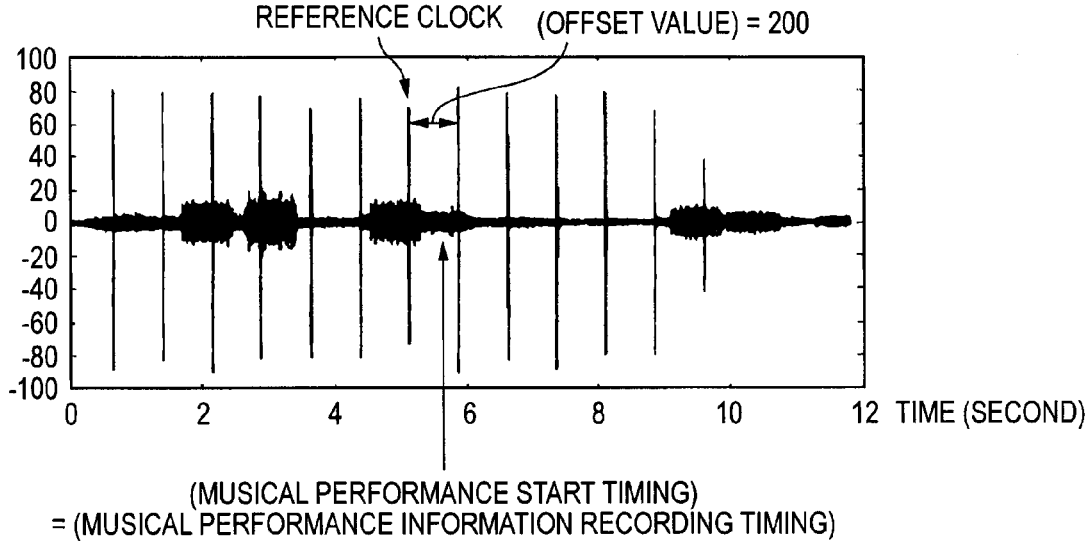
FIG. 22 shows an example of data superimposed on an audio signal and the relationship between a reference clock and an offset value according to the sixth embodiment.

Next, FIG. 22 shows a data string superimposed on an audio signal, and the relationship between the reference clock and the offset value. First, in FIG. 22, (A) shows an example where the actual musical performance start timing (musical sound generating timing) and the musical performance information recording timing coincide with each other. In this case, the timing calculating section 3018 detects the difference from the previous reference clock to calculate the time difference (offset value) from the generation of musical sound, and generates data shown by (B) in FIG. 22.

As shown by (B) in FIG. 22, data superimposed on the audio signal includes the offset value and the musical performance information. The offset value represents the time difference (msec) between the musical performance information recording timing (musical performance start timing) and the previous reference clock.

In the examples of (A) in FIG. 22 and (B) in FIG. 22, the time difference between the musical performance start timing and the reference clock is 200 msec, thus the offset value becomes 200. Then, the timing calculating section 3018 outputs data including information "offset value=200" and the musical performance information to the data superimposing section 3015.

As described above, the electronic piano 3001 superimposes the reference clock and the offset value on the audio signal, and outputs the resultant audio signal, such that information regarding the time difference can be embedded with high resolution. For example, if the offset value with 8 bits is set with respect to the reference clock having a period of about 740 msec, which is the period when an M-series signal of 2047 points is over-sampled 16 times greater with a sampling frequency of 44.1 kHz, high resolution of about 3 msec is obtained. Further, the reference clock and the offset value are recorded as the information regarding the time difference, thus the audio signal does not have to be read from the head on the reproducing side.

Figure 23:
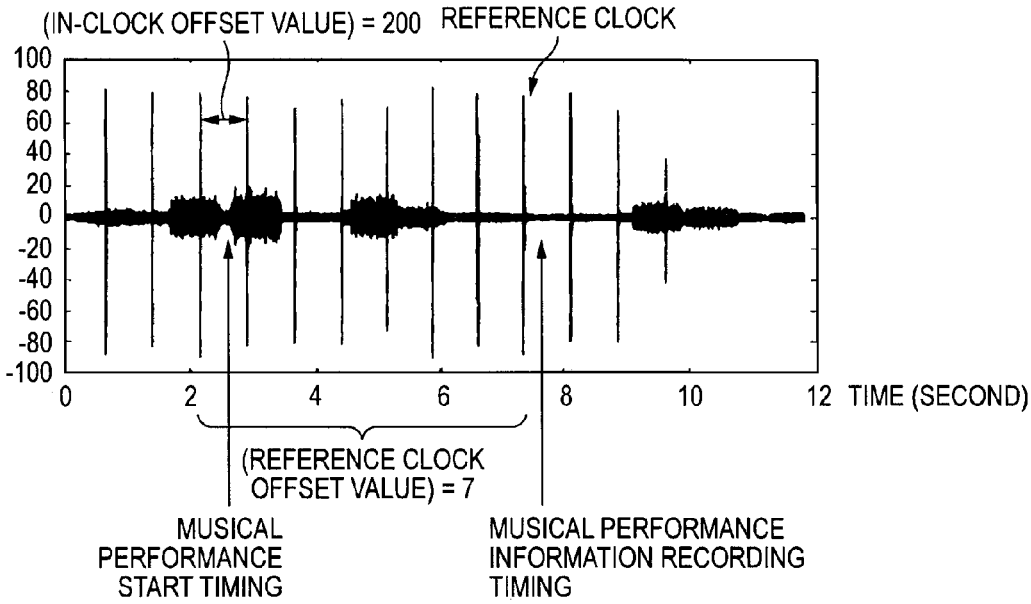
FIG. 23 shows another example of data superimposed on an audio signal according to the sixth embodiment.

Next, FIG. 23 shows another example of data superimposed on an audio signal. In FIG. 23, (A) shows an example where the data superimposing section 3015 superimposes data later than the musical performance start timing by seven beats. The delay from the generation of musical sound until data superimposition occurs, for example, when a silent section exists and watermark information cannot be superimposed or when the delay until the musical performance information is acquired is significant. The timing calculating section 3018 detects the silent section, calculates the time difference from the generation of musical sound, and generates data shown by (B) in FIG. 23.

As shown by (B) in FIG. 23, in this example, a reference clock offset value and an in-clock offset value are defined as the offset value. The reference clock offset value represents the difference (the number of clocks) between the reference clock immediately before the musical performance information recording timing and the reference clock immediately before the actual musical performance start timing. The in-clock offset value represents the time difference (msec) between the musical performance start timing and the reference clock immediately before the musical performance start timing.

In the examples of (A) in FIG. 23 and (B) in FIG. 23, the difference between the reference clock immediately before the musical performance start timing and the reference clock immediately before the musical performance information recording timing has 7 clocks, thus the reference clock offset value becomes 7. Further, the time difference between the musical performance start timing and the previous reference clock is 200 msec, thus the in-clock offset value becomes 200. Then, the timing calculating section 3018 outputs data including information of "reference clock offset value=7 and in-clock offset value=200" and the musical performance information to the data superimposing section 3015.

When the delay time from the instruction for the start of the musical performance until the generation of musical sound is constant, it should suffice that the timing calculating section 3018 calculates the offset value by constantly subtracting a constant value from the timing at which the musical performance information is acquired.

If the reference clock offset value is 0, information regarding the reference clock offset value is not necessary, thus the examples are the same as the examples of (A) in FIG. 22 and (B) in FIG. 22. For the actual use, when there are many situations shown by (A) in FIG. 22 and (B) in FIG. 22, the presence/absence of the reference clock offset value may be defined as a 1-bit flag as follows, reducing the data capacity.

That is, as shown by (C) in FIG. 23, a flag indicating the presence/absence of the reference clock offset value is defined at the head of data. When the flag is 0, the reference clock offset value is 0, thus only the in-clock offset value shown by (D) in FIG. 23 is included in data. When the flag is 1, the reference clock offset value is equal to or greater than 1 (or equal to or smaller than −1, as described below), as shown by (E) in FIG. 23, data includes the reference clock offset value, the in-clock offset value, and the musical performance information.

Figure 24:
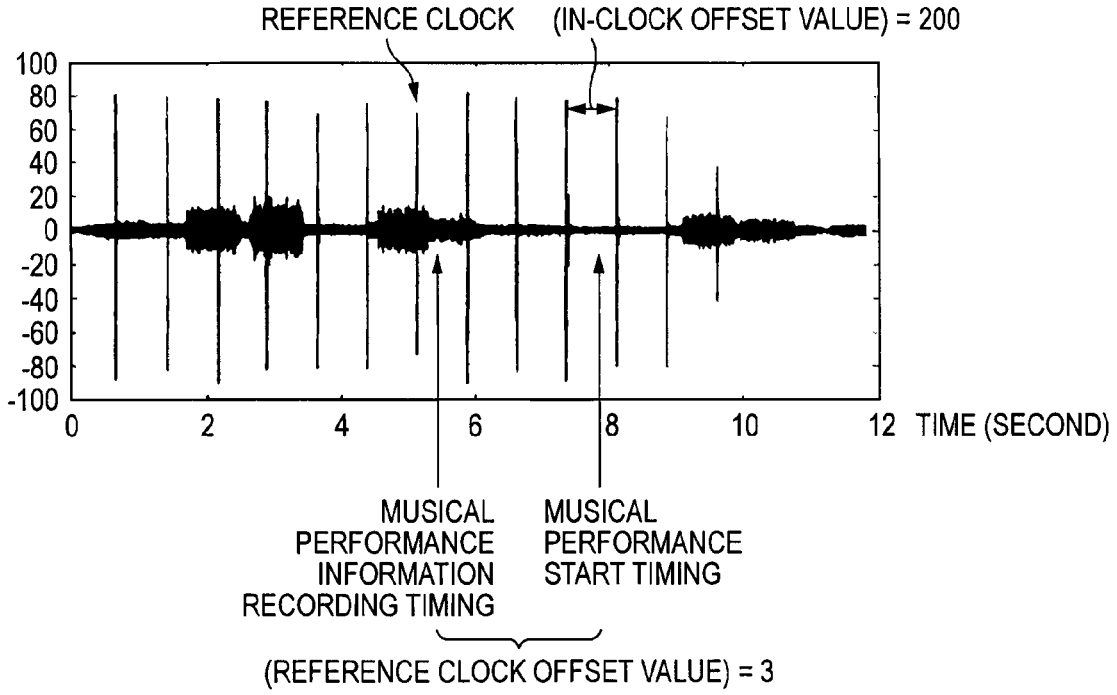
FIG. 24 shows an example where a musical performance start timing is later than a musical performance information recording timing according to the sixth embodiment.

As shown in FIG. 24, even when the musical performance start timing is later than the musical performance information recording timing (a future time is designated), the offset value can be calculated and superimposed. In this case, it should suffice that the reference clock offset value is a negative value (for example, the reference clock offset value=−3). For example, this is appropriately applied to when, as in an automatic musical performance piano or the like, a long mechanical delay occurs from the instruction for the start of the musical performance until actual musical sound is generated. Further, this is also applied to when sequence data superimposed on the audio signal is control information for controlling an external apparatus (an effects unit, an illumination, or the like), when the performer conducts a manipulation input such that an operation starts several seconds earlier, or the like.

Next, the use example of the reference clock and the offset value will be described. In (B) of FIG. 21, the audio signal output from the output I/F 3016 is input to the decoding device 3002. The audio signal output from the electronic piano 3001 can be treated in the same manner as the usual audio signal, thus the audio signal can be recorded by another general recorder. Further, recorded audio data is general-use audio data, thus audio data can be reproduced by a general audio reproducer.

The control unit 3022 reads audio data recorded in the storage section 3023 and outputs audio data to the timing extracting section 3025. The timing extracting section 3025 decodes the offset value and the musical performance information superimposed on the audio signal, and input the offset value and the musical performance information to the control unit 3022. The control unit 3022 synchronously outputs the audio signal and the musical performance information to the outside on the basis of the reference clock input from the reference clock extracting section 3024 and the offset value. When a tempo clock is used as the reference clock, the tempo clock may also be output at this time.

The output audio signal and musical performance information are used for score display or the like. For example, a score is displayed on the monitor on the basis of the note number included in the musical performance information, and musical sound is emitted simultaneously, such that the score can be used as a teaching material for training. Further, the score is output to the sequencer or the like, such that an automatic musical performance can be conducted in synchronization with the audio signal. As described above, a negative value can be used for the reference clock offset value, thus even when the musical performance start timing is later than the musical performance information recording timing, a synchronous musical performance can be conducted accurately.

It is desirable that the control unit 3022 reproduces audio data while buffering some of audio data in an internal RAM (not shown) or the like, or carries out decoding in advance and reads the musical performance information and the offset value in advance.

The sequence data output device of this embodiment is not limited to the mode where a sequence data output device is provided in an electronic musical instrument, and may be attached to the existing musical instrument later. In this case, an input terminal of an audio signal is provided, and a control signal is superimposed on the audio signal input from the input terminal. For example, an electric guitar having a line output terminal or the usual microphone may be connected to acquire an audio signal, or a sensor circuit may be mounted later to acquire the musical performance information. Thus, even in the case of an acoustic instrument, the sequence data output device of the invention can be used.

The sequence data output device (musical performance-related information output device) includes output means for outputting an audio signal generated in accordance with a musical performance manipulation of the performer. The reference clock and sequence data (musical performance information or control information of an external apparatus) according to the manipulation of the performer are superimposed on the audio signal in a band higher than the frequency component of the audio signal. When tempo information is used as the reference clock, the tempo information is superimposed as beat information (tempo clock), such as an MIDI clock. The beat information is constantly output, for example, by the automatic musical performance system (sequencer). The information regarding the time difference between the timing of superimposing sequence data and the reference clock is also superimposed on the audio signal in a band higher than the frequency component of the audio signal.

For this reason, the sequence data output device can output the reference clock, sequence data, and the information regarding the time difference in a state of being included in the audio signal (through the single line). The output audio signal can be treated in the same manner as the usual audio signal, thus the audio signal can be recorded by a recorder or the like and can be used as general-use audio data. When tempo information is used as the reference clock, the time difference between the tempo clock and the timing at which sequence data is superimposed is embedded in the audio signal. Thus, if sequence data is MIDI data (musical performance information), the synchronization with the existing automatic musical performance device is possible. The correction of the time difference from the reference clock enables real-time correction of a delay at the time of the generation of the musical performance information, a mechanical delay until the generation of musical sound, or the like.

According to this method, the time difference from the reference clock generated at a constant interval is superimposed, thus it is not necessary to read the audio signal from the head, and the information regarding the time difference can be embedded with high resolution. For example, when the information is represented by the difference (offset value) from the previous reference clock, if the offset value of 8 bits is set with respect to the reference clock having a period of about 740 msec which is the period when an M-series signal of 2047 points is over-sampled 16 times greater with a sampling frequency of 44.1 kHz, resolution of about 3 msec is obtained. Therefore, this method can be used when high resolution is necessary, like a musical performance of a musical instrument.

The sequence data output device superimposes information on the audio signal such that the modulated component of the information (for example, the information regarding the time difference) is included in a band higher than the frequency component of the audio signal generated in accordance with the musical performance manipulation, and outputs the resultant audio signal. For example, M-series pseudo noise (PN code) may be encoded through phase modulation with the information regarding the time difference. The frequency band on which the information regarding the time difference is desirably an inaudible range equal to or higher than 20 kHz, but in the configuration in which an inaudible range is not used due to D/A conversion, encoding of compressed audio, or the like, for example, the information regarding the time difference is superimposed on a high-frequency band equal to or higher than 15 kHz, reducing the effect for the sense of hearing. With regard to sequence data or the tempo information, the same superimposing method as the information regarding the time difference can be used.

Sequence data may be generated in accordance with the manipulation input of the performer. In this case, the difference between the manipulation input timing (for example, the musical sound generating timing) and the timing of superimposing sequence data is superimposed.

The sequence data output device includes a mode where a sequence data output device is embedded in an electronic musical instrument, such as an electronic piano, a mode where an audio signal is input from the existing musical instrument, a mode where an acoustic instrument or singing sound is collected by a microphone and an audio signal is input, and the like.

A mode may be made in which a sound processing system further includes a decoding device for decoding sequence data by using the above-described sequence data output device.

In this case, the decoding device buffers the audio signal or decodes various kinds of information from the audio signal in advance, and synchronizes the audio signal and sequence data with each other on the basis of the decoded reference clock and offset value.

The superimposing means of the sequence data output device superimposes pseudo noise on the audio signal with the timing based on the reference clock to superimpose the reference clock. As pseudo noise, for example, a signal having high self-correlativity, such as a PN code, is used. When the tempo information is used as the reference clock, the sequence data output device generates a signal having high self-correlativity with the timing based on the musical performance tempo (for example, for each beat), and superimposes the generated signal on the audio signal. Thus, even when sound emission is made as an analog audio signal, there is no case where the superimposed tempo information is lost.

The decoding device includes input means to which the audio signal is input, and a decoding means for decoding the reference clock. The decoding means calculates the correlation between the audio signal input to the input means and pseudo noise, and decodes the reference clock on the basis of the peak-generated timing of the correlation. Pseudo noise superimposed on the audio signal has extremely high self-correlativity. Thus, if the correlation between the audio signal and pseudo noise is calculated by the decoding device, the peak of the correlation having a constant period is extracted. Therefore, the peak-generated timing of the correlation represents the reference clock.

Even when pseudo noise having high self-correlativity, such as a PN code, is at low level, the peak of the correlation can be extracted. Thus, with respect to sound which has no discomfort for the sense of hearing (sound which is scarcely heard), the tempo information can be superimposed and decoded with high accuracy. Further, if pseudo noise is superimposed only in a high band equal to or higher than 20 kHz, pseudo noise can be further scarcely heard.

Meanwhile, with regard to the superimposing method of sequence data, any method may be used. For example, a watermark technique by a spread spectrum and a demodulation method may be used, or a method may be used in which information is embedded out of an audible range equal to or higher than 16 kHz.

This application is based on Japanese Patent Application No. 2008-194459 filed on Jul. 29, 2008, Japanese Patent Application No. 2008-195687 filed on Jul. 30, 2008, Japanese Patent Application No. 2008-195688 filed on Jul. 30, 2008, Japanese Patent Application No. 2008-211284 filed on Aug. 20, 2008, Japanese Patent Application No. 2009-171319 filed on Jul. 22, 2009, Japanese Patent Application No. 2009-171320 filed on Jul. 22, 2009, Japanese Patent Application No. 2009-171321 filed on Jul. 22, 2009, and Japanese Patent Application No. 2009-171322 filed on Jul. 22, 2009, the contents of which are incorporated herein by reference.

INDUSTRIAL APPLICABILITY

According to the musical performance-related information output device of the invention, the musical performance-related information (for example, the musical performance information indicating the musical performance manipulation of the performer, the tempo information indicating the musical performance tempo, the control signal for controlling an external apparatus, or the like) can be superimposed on the analog audio signal without damaging the general versatility of audio data, and the resultant analog audio signal can be output.

REFERENCE SIGNS LIST

1, 4, 7: guitar
3: reproducing device
5: musical performance information output device
6: finger
11: body
12: neck
20: control unit
21: fret switch
22: string sensor
23: musical performance information acquiring section
24: musical performance information converting section
25: musical sound generating section
26: superimposing section
27: output I/F
30: manipulating section
31: control unit
32: input I/F
33: decoding section
34: delay section
35: speaker
36: image forming section
37: monitor
51: pressure sensor
52: microphone
53: main body
111: string
121: fret
531: equalizer
532: musical performance information acquiring section
1001: electronic piano
1011: control unit
1012: musical performance information acquiring section
1013: musical sound generating section
1014: data superimposing section
1015: output I/F
1016: tempo clock generating section
2001, 2004: guitar
2005: control device
2010: string
2011: body
2012: neck
2020: control unit
2021: string sensor
2022: fret switch
2023: musical performance information acquiring section
2024: musical sound generating section
2025: input section
2026: pose sensor
2027: storage section
2028: control signal generating section
2029: superimposing section
2030: output I/F
2051: microphone
2052: main body
2061: effects unit
2062: guitar amplifier
2063: mixer
2064: automatic musical performance device
2121: fret
2271: control signal database
2521: equalizer
MIC: microphone
SP: speaker
3001: electronic piano
3011: control unit
3012: musical performance information acquiring section
3013: musical sound generating section
3014: reference clock superimposing section
3015: data superimposing section
3016: output I/F
3017: reference clock generating section
3018: timing calculating section

The invention claimed is:

1. A musical performance-related information output device comprising:

a musical performance-related information acquiring section configured to acquire musical performance-related information related to a musical performance of a performer;

a superimposing section configured to superimpose the musical performance-related information on an analog audio signal generated in accordance with a musical performance manipulation of the performer so that a modulated component of the musical performance-related information is included in a band higher than a frequency component of the analog audio signal; and an output section that outputs the analog audio signal on which the superimposing section superimposes the musical performance-related information.

2. The musical performance-related information output device according to claim 1, wherein the musical performance-related information acquiring section acquires musical performance information indicating the musical performance manipulation of the performer as the musical performance-related information.

3. The musical performance-related information output device according to claim 2, wherein the superimposing section includes:

a spread code generating section that generates a spread code having a predetermined period;

a modulating section that phase-modulates the spread code in each period on the basis of the musical performance information; and a synthesizing section that synthesizes a modulated signal generated on the basis of the phase-modulated spread code and the analog audio signal in the frequency band higher than the frequency component of the analog audio signal, and outputs the resultant signal as a synthesized signal.

4. The musical performance-related information output device according to claim 2, further comprising:

a generating section configured to detect vibration generated in accordance with the musical performance manipulation and generate an analog audio signal based on the detected vibration, wherein the superimposing section superimposes the musical performance information on the analog audio signal generated by the generating section.

5. The musical performance-related information output device according to claim 1, wherein the musical performance-related information acquiring section acquires tempo information indicating a musical performance tempo as the musical performance-related information.

6. The musical performance-related information output device according to claim 5, wherein the musical performance-related information acquiring section receives a reference tempo signal, which is the reference of the musical performance tempo, from an external source, and extracts the tempo information on the basis of the reference tempo signal.

7. The musical performance-related information output device according to claim 1, further comprising:

a reference clock generating section configured to generate a reference clock at predetermined intervals;

a time difference detecting section configured to detect the time difference between a timing of superimposing sequence data and the reference clock, wherein the musical performance-related information acquiring section acquires information regarding the reference clock, the sequence data, the timing of superimposing the sequence data, and the time difference, as the musical performance-related information.

8. The musical performance-related information output device according to claim 7, further comprising:

a manipulation input section for inputting a manipulation of the performer; and a data generating section configured to generate the sequence data in accordance with a manipulation input of the manipulation input section, wherein the time difference detecting section detects the time difference between the timing of the manipulation input and the timing of superimposing the sequence data by a difference from the reference clock, and information regarding the time difference is represented by the difference.

9. The musical performance-related information output device according to claim 7, wherein the superimposing section includes:

a spread code generating section that generates a spread code having a predetermined period;

a modulating section that phase-modulates the spread code in each period on the basis of superimposing information; and a synthesizing section that synthesizes a modulated signal generated on the basis of the phase-modulated spread code and the analog audio signal in the frequency band higher than the frequency component of the analog audio signal, and outputs the resultant signal as a synthesized signal.

10. The musical performance-related information output device according to claim 7, wherein tempo information in which a musical performance tempo of the performer is reflected is used as the reference clock.

11. A musical performance system comprising:

a musical performance-related information output device; and a reproducing device, wherein the musical performance-related information output device includes:

a musical performance-related information acquiring section configured to acquire musical performance-related information related to a musical performance of a performer;

a superimposing section configured to superimpose the musical performance-related information on an analog audio signal generated in accordance with a musical performance manipulation of the performer so that a modulated component of the musical performance-related information is included in a band higher than a frequency component of the analog audio signal; and an output section that outputs the analog audio signal on which the superimposing section superimposes the musical performance-related information, and wherein the reproducing device includes:

an input section for inputting the analog audio signal output from the output section of the musical performance-related information output device;

a decoding section configured to extract the musical performance-related information from the analog audio signal input to the input section and decode the musical performance-related information; and a synchronous output section that synchronously outputs the analog audio signal and the musical performance information on the basis of the time required for superimposition and decoding of the musical performance information.

12. A sound processing system comprising:

a musical performance-related information output device; and a decoding device configured to decode the tempo information, wherein the musical performance-related information output device includes:

a musical performance-related information acquiring section configured to acquire musical performance-related information related to a musical performance of a performer;

a superimposing section configured to superimpose the musical performance-related information on an analog audio signal generated in accordance with a musical performance manipulation of the performer so that a modulated component of the musical performance-related information is included in a band higher than a frequency component of the analog audio signal; and an output section that outputs the analog audio signal on which the superimposing section superimposes the musical performance-related information, wherein the musical performance-related information acquiring section acquires tempo information indicating a musical performance tempo as the musical performance-related information, wherein the superimposing section of the musical performance-related information output device superimposes pseudo noise on the analog audio signal with a timing based on the musical performance tempo to superimpose the tempo information, and wherein the decoding device includes:

an input section for inputting the analog audio signal; and a decoding section configured to calculate a correlation between the analog audio signal input to the input section and the pseudo noise, and to decode the tempo information on the basis of a peak-generated timing of the correlation.

13. The sound processing system according to claim 12, wherein:

the musical performance-related information acquiring section of the musical performance-related information output device extracts multiple kinds of tempo information in accordance with the respective timings of the musical performance tempo, the superimposing section superimposes multiple kinds of pseudo noise to superimpose the multiple kinds of tempo information, and the decoding section of the decoding device calculates correlations between the analog audio signal input to the input section and the respective multiple kinds of pseudo noise, and decodes the multiple kinds of tempo information on the basis of the peak-generated timings of the respective correlations.

14. The sound processing system according to claim 12 wherein the superimposing section of the musical performance-related information output device includes:

a spread code generating section that generates the pseudo noise as a spread code having a predetermined period;

a modulating section that phase-modulates the spread code in each period on the basis of the tempo information; and a synthesizing section that synthesizes a modulated signal generated on the basis of the phase-modulated spread code and the analog audio signal in the frequency band higher than the frequency component of the analog audio signal, and outputs the resultant signal as a synthesized signal.

15. An electronic musical instrument comprising the musical performance-related information output device according to claim 5.

16. The musical performance-related information output device according to claim 1, further comprising:

an input section for receiving an input of a manipulation for controlling an external apparatus; and a control signal generating section configured to generate a control signal for controlling the external apparatus in accordance with the input of the manipulation received by the input section, wherein the musical performance-related information acquiring section acquires the control signal as the musical performance-related information.

17. The musical performance-related information output device according to claim 16, wherein the superimposing section includes:

a spread code generating section that generates a spread code having a predetermined period;

a modulating section that phase-modulates the spread code in each period on the basis of the control signal; and a synthesizing section that synthesizes a modulated signal generated on the basis of the phase-modulated spread code and the analog audio signal in the frequency band higher than the frequency component of the analog audio signal, and outputs the resultant signal as a synthesized signal.

18. The musical performance-related information output device according to claim 16, further comprising:

a musical performance information acquiring section configured to acquire musical performance information indicating content of the musical performance manipulation; and a storage section for storing the musical performance information and the control signal in association with each other, wherein the input section acquires the musical performance information as the input of the manipulation, and wherein the control signal generating section generates the control signal with reference to the storage section by the musical performance information acquired by the input section.

19. The musical performance-related information output device according to claim 18, further comprising:

a pose sensor that detects the pose of the device to generate pose information, wherein the storage section stores the pose information and the control signal in association with each other, wherein the input section acquires the pose information as the input of the manipulation, and wherein the control signal generating section generates the control signal with reference to the storage section by the pose information acquired by the input section.

20. The musical performance-related information output device according to claim 19, further comprising:

a measuring section configured to measure an elapsed time after the musical performance manipulation starts, wherein the storage section further stores a reception period, for which the input of the manipulation is received, in association with the control signal, and wherein the control signal generating section generates the control signal when the elapsed time measured by the measuring section is within the reception period.

21. The musical performance-related information output device according to claim 18, further comprising:

a control signal input section for inputting the control signal; and a registering section configured to register the control signal input from the control signal input section and the manipulation input from the input section in the storage section in association with each other.

22. The musical performance-related information output device according to claim 16, further comprising:

an audio signal generating section configured to generate the analog audio signal based on vibration generated in accordance with the musical performance manipulation, wherein the superimposing section superimposes the control signal on the analog audio signal generated by the audio signal generating section.

23. A sound processing system comprising:

the musical performance-related information output device according to claim 7; and a decoding device configured to decode information superimposed on the analog audio signal, wherein the decoding device includes a synchronizing section configured to receive the analog audio signal in advance, and to synchronize the analog audio signal and the sequence data on the basis of the reference clock decoded from the analog audio signal and information regarding the time difference.

24. The sound processing system according to claim 23, wherein:

the superimposing section of the musical performance-related information output device superimposes pseudo noise on the analog audio signal with a timing based on the reference clock to superimpose the reference clock, and the decoding device includes a decoding section configured to calculate a correlation between the analog audio signal and the pseudo noise, and decode the reference clock on the basis of a peak-generated timing of the correlation.

25. An electronic musical instrument comprising the musical performance-related information output device according to claim 7.

26. A method of outputting musical performance-related information using a musical performance-related information output device, the method comprising:

a musical performance-related information acquiring step of acquiring musical performance-related information related to a musical performance of a performer;

a superimposing step of superimposing the musical performance-related information on an analog audio signal generated in accordance with a musical performance manipulation of the performer so that a modulated component of the musical performance-related information is included in a band higher than a frequency component of the analog audio signal; and an output step of outputting the analog audio signal on which the superimposing section superimposes the musical performance-related information.

27. A musical performance-related information output device comprising:

a musical performance-related information acquiring section configured to acquire musical performance-related information related to a musical performance of a performer;

a superimposing section configured to superimpose the musical performance-related information on an audio signal generated in accordance with a musical performance manipulation of the performer so that a modulated component of the musical performance-related information is included in a band; and an output section configured to output the audio signal on which the superimposing section superimposes the musical performance-related information, wherein the superimposing section includes:

a spread code generating section configured to generate a spread code having a predetermined period;

a modulating section configured to phase-modulate the spread code in each period based on the musical performance information; and an adding section configured to mix the phase-modulated spread code into the audio signal.

28. The musical performance-related information output device according to claim 27, wherein the band which includes a modulated component of the musical performance-related information is higher than the frequency component of the audio signal.

29. The musical performance-related information output device according to claim 27, wherein the musical performance-related information indicates one of musical performance information, tempo information, control information, a reference clock, sequence data, a timing of superimposing the sequence data on the audio signal, or information indicative of a time difference between the timing of superimposing and the reference clock.

30. An audio reproducing device comprising:

an acquiring section configured to acquire an audio signal on which musical performance information is superimposed;

a decoding section configured to extract and decode the musical performance information from the audio signal; and a synchronous output section configured to output the audio signal synchronously with the musical performance information on the basis of a time required for superimposition and decoding of the musical performance information.

31. The audio reproducing device according to claim 30, wherein the musical performance information is previously superimposed on the audio signal by phase-modulating a spread code in each given period.

32. The audio reproducing device according to claim 30, wherein a frequency component of the musical performance information is higher than a frequency component of the audio signal.

33. An audio decoding device comprising:

an acquiring section configured to acquire an audio signal on which musical performance-related information is superimposed;

a decoding section configured to calculate a correlation between the audio signal and a spread code, and to decode as data code the musical performance-related information from the audio signal; and an outputting section configured to output the decoded musical performance-related information.

34. The audio decoding device according to claim 33, wherein the musical performance-related information is previously superimposed on the audio signal by phase-modulating the spread code in each given period.

35. The audio decoding device according to claim 33, wherein a frequency component of the musical performance-related information is higher than a frequency component of the audio signal.

36. The audio decoding device according to claim 33, wherein the musical performance-related information indicates one of musical performance information, tempo information, control information, a reference clock, sequence data, a timing of superimposing the sequence data on the audio signal, or information indicative of a time difference between the timing of superimposing and the reference clock.

37. The audio decoding device according to claim 33, wherein:

the musical performance-related information indicates a reference clock, sequence data and information indicative of a time difference between the reference clock and a timing of superimposing the sequence data on the audio signal, and the decoding device further includes a synchronizing section configured to synchronize the audio signal with the sequence data on the basis of the reference clock and the information indicative of the time difference which are decoded from the audio signal.

38. A method of controlling a musical performance-related information output device, the method comprising:

an acquiring step of acquiring musical performance-related information related to a musical performance of a performer;

a superimposing step of superimposing the musical performance-related information on an audio signal generated in accordance with a musical performance manipulation of the performer so that a modulated component of the musical performance-related information is included in a band; and an outputting step of outputting the audio signal on which the musical performance-related information is superimposed, wherein the superimposing step comprises:

a generating step of generating a spread code having a predetermined period;

a phase-modulating step of phase-modulating the spread code in each period based on the musical performance information; and a mixing step of mixing the phase-modulated spread code into the audio signal.

39. A non-transitory computer-readable storage medium storing a program executable by a computer to execute a method of controlling a musical performance-related information output device, the method comprising:

an acquiring step of acquiring musical performance-related information related to a musical performance of a performer;

a superimposing step of superimposing the musical performance-related information on an audio signal generated in accordance with a musical performance manipulation of the performer so that a modulated component of the musical performance-related information is included in a band; and an outputting step of outputting the audio signal on which the musical performance-related information is superimposed, wherein the superimposing step comprises:

a generating step of generating a spread code having a predetermined period;

a phase-modulating step of phase-modulating the spread code in each period based on the musical performance information; and a mixing step of mixing the phase-modulated spread code into the audio signal.

* * * * *